US009513594B2

(12) United States Patent
Hasegawa et al.

(10) Patent No.: US 9,513,594 B2
(45) Date of Patent: Dec. 6, 2016

(54) PROTECTIVE LAYER FORMING DEVICE AND IMAGE FORMING APPARATUS

(71) Applicants: Kunio Hasegawa, Kanagawa (JP); Hiroshi Nakai, Kanagawa (JP); Kenji Komito, Kanagawa (JP); Tadashi Kasai, Kanagawa (JP); Takamasa Ozeki, Kanagawa (JP); Jun Hitosugi, Tokyo (JP); Makoto Yasuda, Kanagawa (JP); Emiko Shiraishi, Tokyo (JP); Wakana Itoh, Kanagawa (JP); Takatsugu Komori, Chiba (JP); Mutsuki Morinaga, Kanagawa (JP); Hitoshi Yamamoto, Kanagawa (JP)

(72) Inventors: Kunio Hasegawa, Kanagawa (JP); Hiroshi Nakai, Kanagawa (JP); Kenji Komito, Kanagawa (JP); Tadashi Kasai, Kanagawa (JP); Takamasa Ozeki, Kanagawa (JP); Jun Hitosugi, Tokyo (JP); Makoto Yasuda, Kanagawa (JP); Emiko Shiraishi, Tokyo (JP); Wakana Itoh, Kanagawa (JP); Takatsugu Komori, Chiba (JP); Mutsuki Morinaga, Kanagawa (JP); Hitoshi Yamamoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/540,745

(22) Filed: Nov. 13, 2014

(65) Prior Publication Data

US 2015/0139710 A1 May 21, 2015

(30) Foreign Application Priority Data

Nov. 19, 2013 (JP) ..... 2013-238483
Mar. 7, 2014 (JP) ..... 2014-045579

(51) Int. Cl.
*G03G 21/00* (2006.01)

(52) U.S. Cl.
CPC ..... *G03G 21/0094* (2013.01)

(58) Field of Classification Search
CPC ..... G03G 21/00; G03G 21/0094; G03G 2221/1609; G03G 15/75
See application file for complete search history.

(56) References Cited

U.S. PATENT DOCUMENTS

| | | | |
|---|---|---|---|
| 2006/0285897 | A1 | 12/2006 | Sugiura et al. |
| 2007/0068738 | A1 | 3/2007 | Kawahara et al. |
| 2008/0138132 | A1 | 6/2008 | Yamashita et al. |
| 2009/0196665 | A1 | 8/2009 | Tanaka et al. |

(Continued)

FOREIGN PATENT DOCUMENTS

| | | |
|---|---|---|
| JP | 2006-350240 | 12/2006 |
| JP | 2007-065100 | 3/2007 |

(Continued)

*Primary Examiner* — Gregory H Curran
(74) *Attorney, Agent, or Firm* — Harness, Dickey & Pierce, P.L.C.

(57) ABSTRACT

A protective layer forming device, including: a powdery image bearer protecting agent formed of a granulated product containing a fatty acid metal salt and an inorganic lubricant; and a roller-shaped protecting agent supplying member configured to supply the powdery image bearer protecting agent to a surface of an image bearer.

11 Claims, 9 Drawing Sheets

(56) References Cited

U.S. PATENT DOCUMENTS

| | | | | |
|---|---|---|---|---|
| 2009/0279930 | A1 | 11/2009 | Kabata et al. | |
| 2009/0285613 | A1 | 11/2009 | Nakai et al. | |
| 2009/0290919 | A1 | 11/2009 | Tanaka et al. | |
| 2009/0304423 | A1 | 12/2009 | Ozaki et al. | |
| 2009/0311014 | A1 | 12/2009 | Tanaka et al. | |
| 2010/0021205 | A1* | 1/2010 | Honjoh et al. | 399/123 |
| 2010/0034560 | A1 | 2/2010 | Tanaka et al. | |
| 2010/0054829 | A1 | 3/2010 | Iio et al. | |
| 2010/0183972 | A1 | 7/2010 | Hasegawa et al. | |
| 2010/0209143 | A1 | 8/2010 | Nakai et al. | |
| 2010/0239309 | A1 | 9/2010 | Tanaka et al. | |
| 2010/0278558 | A1 | 11/2010 | Enoki et al. | |
| 2010/0291162 | A1* | 11/2010 | Haas | A61K 8/0216 424/401 |
| 2010/0310291 | A1 | 12/2010 | Tanaka et al. | |
| 2011/0008088 | A1 | 1/2011 | Nakai et al. | |
| 2011/0038656 | A1 | 2/2011 | Hasegawa et al. | |
| 2011/0052286 | A1 | 3/2011 | Urayama et al. | |
| 2011/0085824 | A1 | 4/2011 | Hatakeyama et al. | |
| 2011/0129269 | A1 | 6/2011 | Seo et al. | |
| 2011/0223527 | A1 | 9/2011 | Iio et al. | |
| 2012/0057912 | A1 | 3/2012 | Hasegawa et al. | |
| 2012/0060753 | A1 | 3/2012 | Tanaka et al. | |
| 2012/0063809 | A1 | 3/2012 | Tanaka et al. | |
| 2012/0063825 | A1 | 3/2012 | Hasegawa et al. | |
| 2012/0141177 | A1 | 6/2012 | Urayama et al. | |
| 2012/0195662 | A1 | 8/2012 | Hasegawa et al. | |
| 2013/0216286 | A1 | 8/2013 | Hasegawa et al. | |
| 2013/0259552 | A1 | 10/2013 | Hasegawa et al. | |
| 2013/0315642 | A1 | 11/2013 | Nakai et al. | |
| 2014/0030644 | A1 | 1/2014 | Hasegawa et al. | |
| 2014/0093294 | A1 | 4/2014 | Komito et al. | |

FOREIGN PATENT DOCUMENTS

| | | |
|---|---|---|
| JP | 2007-293240 | 11/2007 |
| JP | 2009-150986 | 7/2009 |
| JP | 2010-133997 | 6/2010 |
| JP | 2010-152352 | 7/2010 |
| JP | 2012-058539 | 3/2012 |
| JP | 2012-123209 | 6/2012 |

* cited by examiner

PROTECTIVE LAYER FORMING DEVICE AND IMAGE FORMING APPARATUS

BACKGROUND OF THE INVENTION

1. Field of the Invention

The present invention relates to a protective layer forming device and an image forming apparatus.

2. Description of the Related Art

In conventional electrophotographic image formation, a visible image is formed by forming a latent image of electrostatic charges on an image bearer (referred to also as "electrostatic latent image bearer," "electrophotographic photoconductor," or "photoconductor"), and adhering charged toner particles to the electrostatic latent image. The visible image formed by the toner is finally transferred onto a recording medium such as paper and is fixed on the recording medium, for example, by heat, pressure, a solvent, or gas to form an output image.

Electrophotographic image forming methods are roughly classified according to toner charging methods for visualization into the so-called two-component development method using tribocharging by stirring or mixing of toner particles and carrier particles and the so-called one-component development method in which charges are applied to toner particles without the use of carrier particles. The one-component development method is more advantageous in space saving and cost reduction than the two-component development method. Accordingly, the one-component development method is mainly used in small printers, facsimile machines and the like.

In these electrophotographic image forming apparatuses, a method is adopted that contains uniformly performing charging while rotating an image bearer generally having a drum or belt shape regardless of a development method, forming a latent image pattern by laser beams or the like on the image bearer, visualizing the latent image pattern by a developing device, and further transferring the visualized image onto a recording medium.

A toner component that remains untransferred stays on the image bearer after the transfer of the visible image on the recording medium. When the residual toner component is conveyed as it is without being processed to thereby perform a charging step, even charging of the image bearer is sometimes hindered. Accordingly, a method is generally adopted in which, after the transferring step, the toner component and the like that stay on the image bearer are removed by a cleaning step to satisfactorily clean the surface of the image bearer, followed by charging.

In recent years, due to a reduction in size and a reduction in cost of electrophotographic image forming apparatuses, a contact charging method and a proximity charging method are mainly used in the charging step in the image formation. It is, however, difficult to evenly electrify the surface of the image bearer due to, for example, a slight unevenness of the contact between the charging member and the surface of the image bearer and a variation in gap between the charging member and the surface of the image bearer. For this reason, an AC superimposed charging method has been used, and in this method an alternating current AC component is superimposed on a direct current DC component.

The proximity charging method by the AC superimposed charging can realize a reduction in size of a device and an improvement in image quality and, at the same time, renders the charging unit and the image bearer non-contact while maintaining even charging. Thus, deterioration in the charging unit can be suppressed.

When the image bearer is an organic photoconductor (OPC), the energy of the AC superimposed charging, however, cuts molecular chains of the resin forming the surface of the image bearer, resulting in lowered mechanical strength that leads to remarkably progressed abrasion of the image bearer. Further, since the AC superimposed charging activates the surface of the image bearer, a problem occurs that the adhesion between the surface of the image bearer and the toner increases and, thus, the capability of the image bearer to be cleaned is lowered.

On the other hand, a recent tendency towards color output images has led to the development of toners that have smaller particle diameters and are circular, for improved image quality and image quality stabilization purposes. This tendency poses an increasing problem of cleaning in the electrophotographic image formation method. In order to remove the residual toner by cleaning, it is necessary to apply a higher rubbing force of the cleaning member against the image bearer than the force applied in the conventional technique. Accordingly, there is a problem of remarkable abrasion of the image bearer, the cleaning member and the like.

In each step for the electrophotographic image formation, electrical stress and physical stress exist. The image bearer that has undergone these stresses causes a change in the surface state with the elapse of time.

Coating a protective agent on the image bearer is known to be effective for solving the above problems. Examples of proposals for coating include one in which a block-shaped protective agent formed mainly of zinc stearate, a so-called protective agent block, is coated on an image bearer (see Japanese Patent Application Publication (JP-B) No. 51-22380) and one in which a protective agent block prepared by adding boron nitride to a protective agent block formed mainly of zinc stearate is coated on an image bearer (see Japanese Patent Application Laid-Open (JP-A) No. 2006-350240).

Coating the protective agent block onto the image bearer lowers a coefficient of friction on an image bearer to reduce a deterioration in a cleaning member or an image bearer and to improve the separation of an adhered material such as an untransferred toner adhered on the image bearer. As a result, a failure of cleaning and occurrence of filming with the elapse of time can be suppressed.

Further, regarding a technique for coating a protective agent block onto the image bearer, a proposal has been made on a protective layer forming apparatus containing: a protective agent block; a protective agent feeding member formed of a brush-shaped rotary member that is brought into contact with the protective agent block and coats the protective agent, which has been adhered on the surface, onto an image bearer; and a protective agent pressing member that presses the protective agent block to allow the protective agent block to be brought into contact with the protective agent feeding member (see JP-A Nos. 2007-65100 and 2007-293240).

In these proposed techniques, however, a large amount of a protective agent powder produced from the protective agent block by rubbing with the brush-shaped rotary member, and is blown into the air by the rotation of the brush-shaped rotary member. Therefore, this poses a problem that a large amount of the protective agent is wasted. Further, the above techniques are disadvantageous in that bristle inclination or deterioration of brush fibers occurs with the elapse of time, the consumption of the protective agent is not stable, and the protective agent cannot be fed at a given amount over a long period of time.

Therefore, a technique has been proposed in which a roller-shaped protective agent feeding member containing a foam layer is used as a protective agent feeding member in a protective layer forming apparatus (see JP-A No. 2009-150986). According to this proposal, flying of the protective agent powder by rubbing hardly occurs.

In this proposed technique, however, the foam layer is composed of closed cells and thus degraded or broken over time due to rubbing with a protecting agent block or an image bearer. As a result, it is not possible to sufficiently supply the protecting agent to an image bearer for a long period of time, which will cause disadvantages such as filming of an image bearer.

In order to solve the above problem, there has been a foam roller containing a foam layer composed of open cells (see JP-A No. 2012-58539). According to this proposal, it is possible to apply a protecting agent to an image bearer for a long period of time. This proposal, however, scrapes a protecting agent block with a brush or a roller to supply it to an image bearer. Hence, an amount of the protecting agent block consumed disadvantageously varies depending on high-temperature, high-humidity environments. Particularly in winter, the protecting agent block is consumed in a large amount. Therefore, powder of the protecting agent having passed through a cleaning blade flies to a charging member, resulting in smear of the charging member to lead to formation of an abnormal image.

Meanwhile, there has been a further demand for longer service life of image forming apparatuses. Trying to respond to such demand for longer service life will need to increase the amount of the protecting agent block itself (need to enlarge the protecting agent block). The enlarged protecting agent black needs an extra housing space. Thus, there is a problem that it is not possible to follow a trend of downsizing since a protective layer forming device will become larger. Therefore, methods have been attempted which supply a protecting agent in the form of powder or granules to an image bearer via a protecting agent supplying member, in addition to supply methods by scraping a protecting agent block.

Furthermore, attempts have been mate to supply a powdery protecting agent using a brush roller as a protecting agent supplying member. For example, there has been proposed a method including supplying a powdery protecting agent using a brush roller as a protecting agent supplying member, and sealing with a fiber fabric which allows only fine powder of the protecting agent to pass therethrough (see JP-A No. 2010-152352).

Moreover, there has been proposed another method including supplying a powdery protecting agent using a brush roller as a protecting agent supplying member, and charging the powdery protecting agent to have opposite polarity to toner before application (see JP-A No. 2010-133997).

When the powdery protecting agent is supplied with a brush roller as in these proposals, however, the amount of the protecting agent supplied will be excessively large. As a result, a large amount of the protecting agent problematically passes through a cleaning blade to contaminate a charging member.

The aforementioned JP-A No. 2010-133997 uses a protecting agent made only of zinc stearate which is a fatty acid metal salt, and thus the protecting agent after a charging step is lost in lubricity, raising a problem of further accelerating smear of the charging member.

The aforementioned JP-A No. 2010-152352 uses a protecting agent made of a plurality of ingredients which are zinc stearate, which is a fatty acid metal salt, and a lubricating material. However, the protecting agent made of a plurality of ingredients is not formed into a single particle or granule, and thus these two or more protecting agents will be separated over time in a storage portion of the protecting agent. Then, the protecting agent cannot be consumed over time in predetermined amounts, raising a problem of causing filming of an image bearer and smear of a charging roller.

The applicants of the present application previously proposed an image forming method including a developing step of developing a electrostatic latent image formed on an image bearer with a developer, wherein the developer contains a granulated product and a toner, the granulated product containing: an image bearer protecting agent ingredient containing a fatty acid metal salt; and a lubricating agent ingredient containing at least one selected from silica, alumina, acrylic particles, and boron nitride (see JP-A No. 2012-123209).

According to this proposal, it is described that the median diameter (D50) of the granulated product is preferably 10 μm to 100 μm, and when it exceeds 100 μm, the granulated product will be degraded in protecting performance for a photoconductor.

According to this proposal, it is possible to prevent abrasion and filming of an image bearer, smear of a charging member, and unfavorable passing of toner particles.

When the granulated product of the protecting agent is supplied as a developer as in the above proposal, however, the lubricant is supplied together with the toner and thus the toner (containing external additives) having a smaller particle diameter than the granulated product positively passes through a cleaning blade, easily causing fish marks and filming as a result of deposition of silica, which is an external additive, on an image bearer. Also, the amount of the protecting agent supplied varies in a longitudinal direction depending on the area of an output image. For example, when non-image portions (where no image is formed) are printed successively, little of the protecting agent is supplied, disadvantageously contaminating an image bearer to cause filming and fish marks thereon. In contrast, when images with a high image density are printed successively, supply of the protecting agent may become insufficient.

Accordingly, demand has arisen for provision of a protective layer forming device capable of stably supplying a constant amount of a protecting agent to an image bearer with low pressure for a long period of time and forming images with a high image density for a long period of time, without degrading or breaking the protecting agent supplying member.

SUMMARY OF THE INVENTION

The present invention aims to provide a protective layer forming device capable of stably supplying a constant amount of a protecting agent to an image bearer with low pressure for a long period of time without degrading or breaking the protecting agent supplying member.

A protective layer forming device of the present invention as a means for solving the above problems includes:

a powdery image bearer protecting agent formed of a granulated product containing a fatty acid metal salt and an inorganic lubricant; and a roller-shaped protecting agent supplying member configured to supply the powdery image bearer protecting agent to a surface of an image bearer.

According to the present invention, it is possible to provide a protective layer forming device capable of stably supplying a constant amount of a protecting agent to an image bearer with low pressure for a long period of time without degrading or breaking the protecting agent supplying member. This protective layer forming device can solve the above existing problems.

DETAILED DESCRIPTION OF THE INVENTION (Protective Layer Forming Device)

A protective layer forming device of the present invention includes a powdery image bearer protecting agent and a roller-shaped protecting agent supplying member, preferably includes a protecting agent storage member and a protective layer forming member, further includes other materials, if necessary.

<Powdery Image Bearer Protecting Agent>

The powdery image bearer protecting agent consists of a granulated product containing a fatty acid metal salt and an inorganic lubricant.

The granulated product means particles having a prescribed size which are obtained by allowing powder to undergo adhesion and aggregation and/or compression.

A method for obtaining the granulated product is not particularly limited, and may be appropriately selected depending on the intended purpose. Examples thereof include a dry granulation method, a wet granulation method, and melting/pulverizing method. Among them, the dry granulation method is particularly preferable from the viewpoint of being environmental-friendly since solvents are not used for the method.

The dry granulation method is a method, where powdery raw materials are compressed, a massive and platy product having a high density is obtained, and the obtained product is crashed or cracked to thereby obtain a granulated product having a predetermined size by well-ordered particles.

Figure 1:
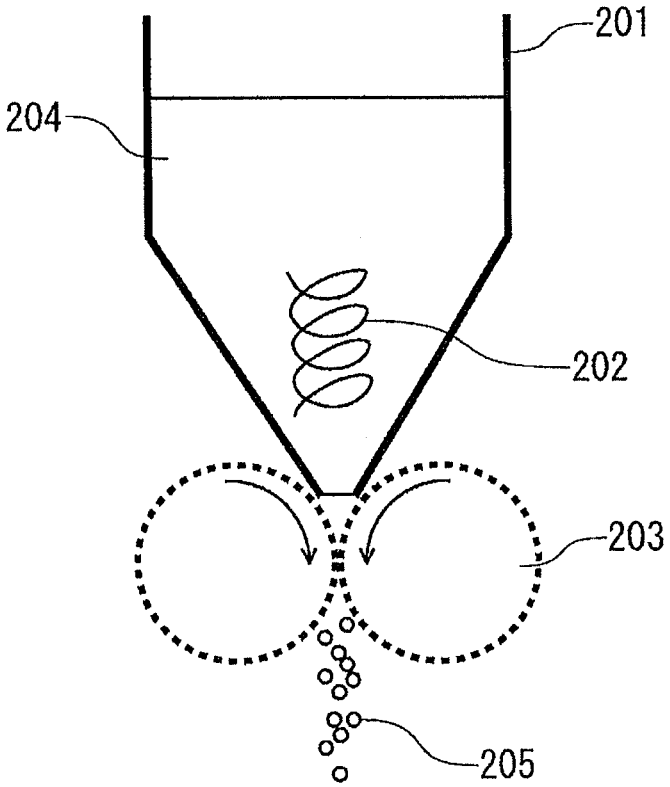
FIG. 1 shows a schematic diagram illustrating one example of an apparatus by dry granulation for producing a granulated product which contains a fatty acid metal salt and an inorganic lubricant.

Here, FIG. 1 shows a schematic diagram illustrating one example of an apparatus by dry granulation. The apparatus for producing the granulated product is equipped with a tank 201, configured to store a protecting agent-forming ingredient 204 which contains a fatty acid metal salt and an inorganic lubricant, a screw 202, and a pair of rolls 203.

A method for producing a granulated product with the apparatus for producing the granulated product by dry granulation will be described hereinafter. First, the protecting agent-forming ingredient which consists of a fatty acid metal salt and an inorganic lubricant is charged into the tank 201, and mixed in the screw 202. Then, the mixed particles are extruded from the screw 202 little by little and go into through a pair of rolls 203. Between a pair of rolls 203, the mixed particles are condensed to thereby produce a granulated powder 205. Note that, producing the granulated product is a granulated product where once compressed-particles are pulverized or classified to thereby obtain a granulated product and the diameter of the obtained granulated product can be controlled by the step of the pulverizing or classifying.

As the apparatus for producing the granulated product by dry granulation, commercially available products may be used. Examples thereof include a roller compacter (FT160, product of FREUND-TURBO CORPORATION).

The wet granulation method is not particularly limited and may be appropriately selected depending on the intended purpose. Examples thereof include a method for forming a granulated product, where water or a binding agent dissolving solution is added droplet or splayed to protecting agent powders, followed by allowing to wet, and wet particles are allowed to dry to produce a granulated product.

The melting/pulverizing method is a method where a mixed protecting agent is allowed to melt, cool, and solidify to thereby obtain granules by pulverizing with a pulverizer.

The particle diameter of the granulated product as the powdery image bearer protecting agent is not particularly limited and may be appropriately selected depending on the intended purpose. The median diameter (D50) based on the volume standard particle size distribution obtained by measuring by a laser diffraction scattering particle size distribution measurement method, is preferably from 50 μm to 1,100 μm, more preferably from 110 μm to 500 μm, still more preferably from 200 μm to 400 μm. When the median diameter (D50) is less than 50 μm, the particle diameter of the protecting agent supplied is so small that it easily passes through a coating blade and is easily allowed to jet to a charging roller. When the median diameter (D50) is more than 1,100 μm, coating evenness of the image bearer is likely to occur, and filming is likely to occur.

The particle diameter of the granulated product may be measured with a laser diffraction particle size analyzer (MASTERSIZER 2000, product of Malvern) and the like.

The bulk density of the granulated product as the powdery image bearer protecting agent is not particularly limited and may be appropriately selected depending on the intended purpose. The bulk density thereof is preferably from 0.1 $g/cm^3$ to 1.0 $g/cm^3$, more preferably from 0.3 $g/cm^3$ to 0.6 $g/cm^3$. When the bulk density is less than 0.1 $g/cm^3$, from the viewpoint of production, particles are difficult to fill, and large space for filling is likely to need when the amount of the protecting agent needed is filled.

The bulk density of the powdery image bearer protecting agent may be measured, for example, with a powder characteristics measuring apparatus, which is product of TSUTSUI SCIENTIFIC INSTRUMENTS CO., LTD.

In the granulated product as the powdery image bearer protecting agent, a mass ratio (fatty acid metal salt/inorganic lubricant) of the fatty acid metal salt to the inorganic lubricant is not particularly limited and may be appropriately selected depending on the intended purpose. The mass ratio thereof is preferably from 92/8 to 65/35, more preferably from 90/10 to 75/25. When the mass ratio of the fatty acid metal salt is higher than the upper limited of the range falling within the mass ratio (fatty acid metal salt/inorganic lubricant), the amount of film formation becomes low, phenomenon is likely to cause smear of the charging member and deterioration in cleaning properties. On the other hand, the ratio of the inorganic lubricant is higher than the ratio falling within the mass ratio (fatty acid metal salt/inorganic lubricant), protective property of a photoreceptor is likely to deteriorate.

When the mass ratio (fatty acid metal salt/inorganic lubricant) is within the preferable range, obtained are advantages where the amount of expensive boron nitride may be low, forming property is good, no smear of the charging member is observed, and cleaning property and protective property of the photoreceptor are improved.

<<Fatty Acid Metal Salt>>

The fatty acid metal salt is not particularly limited and may be appropriately selected depending on the intended purpose. Examples thereof include barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminium palmitate, calcium palmitate, lead caprylate, lead caprate, zinc linolenate, cobalt linolenate, calcium linolenate, zinc ricinoleate, and cadmium ricinoleate. These may be used alone or in combination. Among them, zinc stearate, calcium stearate, and zinc laurate are preferable. From the viewpoints of excellent image bearer-protecting property, zinc stearate is particularly preferable.

<<Inorganic Lubricant>>

The inorganic lubricant, as used herein, means a compound which exhibits lubricating properties by being cleaved or which induces internal lubricating action.

The inorganic lubricant is not particularly limited and may be appropriately selected depending on the intended purpose. Examples thereof include mica, boron nitride, molybdenum disulfide, tungsten disulfide, talc, kaolin, montmorillonite, calcium fluoride, and graphite. These may be used alone or in combination. Among them, boron nitride, mica, and talc are preferable, and boron nitride is particularly preferable since it is a substance in which hexagonal network planes formed by firmly bonded atoms are laminated on top of one another with sufficient space therebetween, and the planes are bonded by only a weak van der Waals force; therefore, the planes are easily cleaved to thereby exhibit lubricating properties.

The average primary particle size of the inorganic lubricant is not particularly limited and may be appropriately selected depending on the intended purpose, and the average primary particle size thereof is preferably from 0.1 μm to 10 μm. When the average primary particle size thereof is within the preferable range, cleaning property is improved and filming can be prevented on a photoreceptor.

The average primary particle size of the inorganic lubricant can be measured, for example, as follows. Specifically, the inorganic lubricant is observed, for example, with a scanning electron microscope (SEM) (THERMAL F-SEM, product of Zeiss, ULTRA55), and the obtained image is measured with an image analysis/measurement software (IMAGE-PRO PLUS 4.0 J, product of Media Cybernetics). The average of the number of the ten portions is determined.

<Roller-Shaped Protecting Agent Supplying Member>

The roller-shaped protecting agent supplying member is a member which provides the powdery protecting agent onto the surface of an image bearer. Note that, the roller-shaped protecting agent supplying member does not include the so-called brush roller.

In a first embodiment, the roller-shaped protecting agent supplying member is preferably a foamed urethane roller.

In a second embodiment, the roller-shaped protecting agent supplying member is preferably a rubber roller.

<<Foamed Urethane Roller of First Embodiment>>

The foamed urethane roller of the first embodiment preferably includes a core and a foam layer formed on the outer periphery of the core.

—Core—

The material, shape, size, and structure of the core are not particularly limited and may be appropriately selected depending on the intended purpose.

Material for the core includes, for example, resins and metals. Examples of such resins include epoxy resins and phenolic resins. Examples of the metals include iron, aluminium, and stainless steel.

Examples of the shape of the core include a columnar shape and a cylindrical shape.

—Foam Layer—

The foam layer is formed on the outer periphery of the core.

Materials of the foam layer are not particularly limited and may be appropriately selected depending on the intended purpose. Examples thereof include polyurethane foam.

The polyurethane foam is not particularly limited and may be appropriately selected depending on the intended purpose. Examples thereof include polyurethane foam obtained by mixing at least a polyol, a polyisocyanate, a catalyst, and a foaming agent together and further include other ingredients such as foam stabilizers and allowing a reaction to proceed, if necessary.

The polyol is not particularly limited and may be appropriately selected depending on the intended purpose. Examples thereof include polyether polyol and polyester polyol. Among them, polyether polyol is preferable from the viewpoints of easiness in regulating processability, and hardness of the foam layer.

Examples of the polyether polyol include polyether polyol obtained by providing, as an initiator, low-molecular polyol and/or low-molecular polyamine having 2 to 8 active hydrogen groups and subjecting at least either of ethylene oxide or propylene oxide to ring-opening addition polymerization with the initiator.

Examples of the polyether polyol include those generally used in the production of flexible polyurethane foam, such as polyether polyether polyol, polyester polyether polyol, and polymer polyether polyol.

The polyether polyol is preferably polyether polyether polyol, to the terminal of which 5% by mole or more of ethylene oxide has been bonded, from the viewpoint of moldability.

Examples of the polyester polyol include those obtained by polymerizing dibasic acid (e.g., adipic acid, phthalic anhydride, isophthalic acid, terephthalic acid, and maleic anhydride) or an anhydride thereof with glycol or triol (e.g., ethylene glycol, diethylene glycol, triethylene glycol, propylene glycol, dipropylene glycol, 1,4-butanediol, glycerin, and trimethylolpropane). These may be used alone or in combination.

Further, polyester polyol prepared by depolymerizing a waste material of a polyethylene terephthalate resin with the above glycol may also be used.

The polyisocyanate is not particularly limited and may be appropriately selected depending on the intended purpose. Examples thereof include 2,4-tolylenediisocyanate (2,4-TDI), 2,6-tolylenediisocyanate (2,6-TDI), tolidinediisocyanate (TODI), naphthylenediisocyanate (NDI), xylylenediisocyanate (XDI), 4,4'-diphenylmethanediisocyanate (MDI), carbodiimide-modified MDI, polymethylenepolyphenylpolyisocyanate, and polymeric polyisocyanate. These may be used alone or in combination.

The amount of the polyisocyanate is not particularly limited and may be appropriately selected depending on the intended purpose. For example, the equivalent ratio (NCO/OH) of the isocyanate group of the polyisocyante to the hydroxyl group of the polyol preferably falls within the range of 1.0 to 3.0.

The catalyst is not particularly limited and may be appropriately selected depending on the intended purpose. Examples thereof include an amine catalyst and an organometal catalyst.

Examples of the amine catalyst include triethylenediamine, dimethylethanolamine, and bis(dimethylamino)ethyl ether.

Examples of the organometal catalyst include dioctyltin, distearyltin dibutyrate.

The catalyst may be a reactive catalyst such as dimethylaminoethanol containing active hydrogen. These may be used alone, or in combination.

The amount of the catalyst is not particularly limited and may be appropriately selected depending on the intended purpose but is preferably 0.01 parts by mass to 20 parts by mass relative to 100 parts by mass of the polyol.

The foaming agent is not particularly limited and may be appropriately selected depending on the intended purpose, and examples thereof include water, fluorocarbon compounds, and low-boiling hydrocarbon compounds.

Examples of the fluorocarbon compound include HCFC-141b, HFC-134a, HFC-245fa, and HFC-365mfc.

Examples of the low-boiling hydrocarbon compound include cyclopentane, n-pentane, iso-pentane, and n-butane.

These foaming agents may be used alone, or in combination.

The amount of the foaming agent is not particularly limited and may be appropriately selected depending on the intended purpose but is preferably 5 parts by mass to 50 parts by mass relative to 100 parts by mass of the polyol.

The foam stabilizer is not particularly limited and may be appropriately selected depending on the intended purpose. Examples of the foam stabilizer include a silicone surfactant.

Commercially available products may be used as the silicone surfactant, and examples of the commercially available products include a dimethylsiloxane foam stabilizer (e.g., "SRX-253", product of Dow Corning Toray Co., Ltd., and "F-122", product of The Shin-Etsu Chemical Co., Ltd.), and a polyether-modified dimethylsiloxane foam stabilizer (e.g., "L-5309" and "SZ-1311", product of Nippon Unicar Co., Ltd.).

The amount of the foam stabilizer is not particularly limited and may be appropriately selected depending on the intended purpose but is preferably 0.2 parts by mass to 10 parts by mass relative to 100 parts by mass of the polyol.

Examples of other ingredients include a crosslinking agent and a foam breaker for regulating the formation of closed-cell type or open-cell type.

The crosslinking agent is not particularly limited and may be appropriately selected depending on the intended purpose. Examples of the crosslinking agent include triethanolamine and diethanolamine.

The foam breaker is not particularly limited and may be appropriately selected depending on the intended purpose. Examples of the foam breaker include a foam stabilizer having high foam breaking properties among the above foam stabilizers.

In producing the polyurethane foam, a method may be used in which starting materials for the polyurethane foam other than the polyisocyanate are previously mixed together and, immediately before the molding, the mixture and the polyisocyanate are mixed together.

The shape of the foam layer is not particularly limited and may be appropriately selected depending on the intended purpose. Examples thereof include a cylindrical shape.

The average thickness of the foam layer is not particularly limited and may be appropriately selected depending on the intended purposes but is preferably 1 mm to 4 mm. When the average thickness thereof is less than 1 mm, the foam layer is subjected to be affected by a shaft (core).

When the foam layer is cylindrical, the distance between the inner periphery and the circumscribed surface in the cylindrical shape is regarded as the thickness.

The average thickness is an average of measured values obtained by measuring the thickness at any three points of the foam layer.

The structure of the foam layer is not particularly limited and may be appropriately selected depending on the intended purpose, and examples thereof include a structure of closed-cell type and a structure of open-cell type. The structure of open-cell type is preferred since the compressive residual strain is so small that, even when the foam layer having a structure of open-cell type is compressed, the foam layer is easily returned to an original shape and is thus hardly deformed even after long-term use.

Figure 2A:
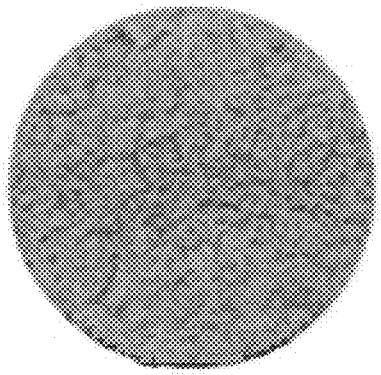
FIG. 2A is a photograph of one example of a foam layer of closed cell type.
Figure 2B:
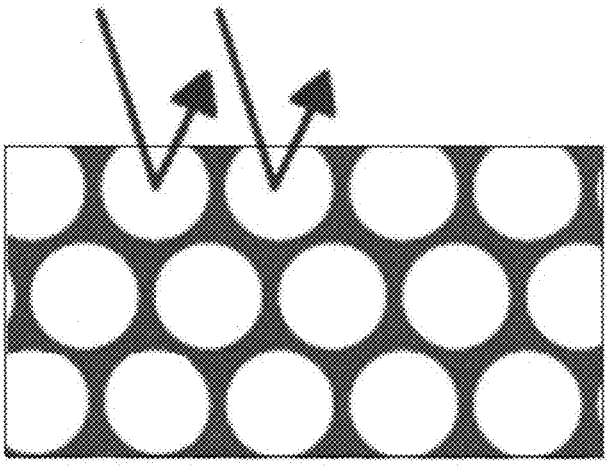
FIG. 2B is a schematic cross-sectional diagram of one example of the foam layer of closed-cell type.

The foam layer having of the structure containing the closed cells refers to a foam layer having a structure that contains small pores (which may be referred to as "cells") independently of each other, and air or water is impermeable thereto as shown by the arrows of FIG. 2B.

Figure 3A:
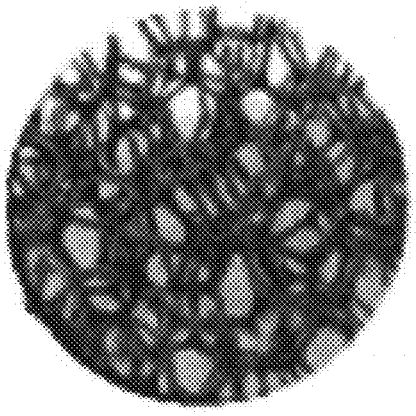
FIG. 3A is a photograph of one example of a foam layer of open-cell type.
Figure 3B:
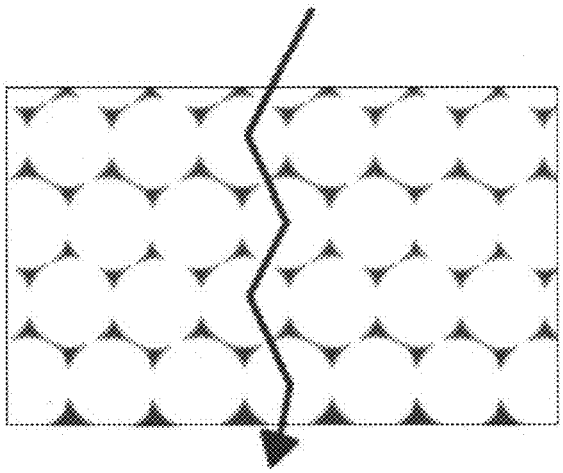
FIG. 3B is a schematic cross-sectional diagram of one example of the foam layer of open-cell type.

The foam layer of the structure containing the open cells refers to a foam layer that contains cells, wherein adjacent cells are connected to each other, and air or water is permeable thereto shown by the arrow of FIG. 3B.

The number of cells in the foam layer is not particularly limited and may be appropriately selected depending on the intended purposes, but is preferably from 25 cells/inch (25.4 mm) to 300 cells/inch (25.4 mm), more preferably from 50 cells/inch to 150 cells/inch. When the number of cells in the foam layer is less than 25 cells/inch, the reduction of smear in the image bearer may be difficult, and when the number thereof is more than 300 cells/inch (1 inch=2.54 cm), the suppression of smear in the image bearer may be difficult. When the number of cells falls within more preferred range than the above-mentioned range, suppression of smear in the image bearer may be advantageously more excellent.

The number of cells is an average of measured values obtained by the following method.

Figure 4A:
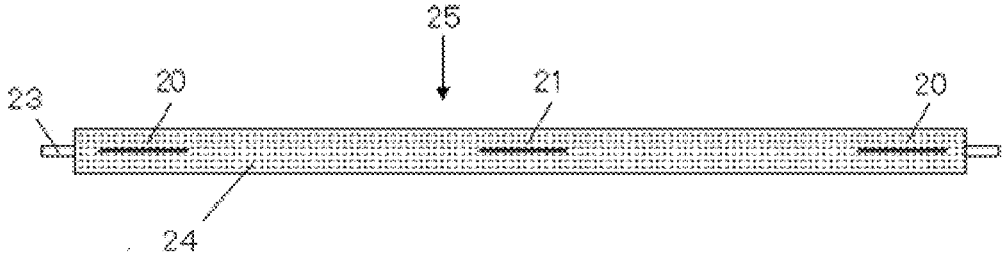
FIG. 4A is a front view of a protecting agent supplying member.
Figure 4B:
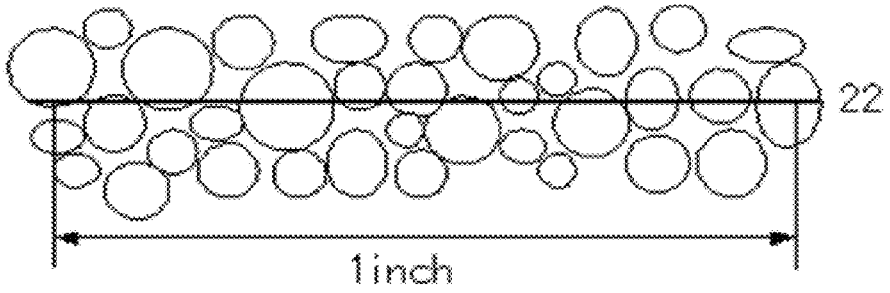
FIG. 4B is an enlarged view of a foam layer of the protecting agent supplying member.

In the surface of the foam layer, any three places (numerals 20 and 21 in FIG. 4A) are selected at a position around each of both ends and a center portion in an axial direction of the protecting agent supplying member. Here FIG. 4A is a front view of a protecting agent supplying member. A protecting agent supplying member 25 has a foam layer 24 on an outer periphery of a core 23. In FIG. 4A, numeral 20 represents a measuring portion at the end and numeral 21 represents a measuring portion at the center portion. Next, in each measuring portion, two portions are further selected in a circumferential direction (not shown in FIG. 4A). Thus, nine measuring portions in total are determined. A photograph screen of each measuring portion is then observed under a microscope. As shown in FIG. 4B, a line 22 having a length corresponding to an actual size of one inch (25.4 mm) is then drawn at the center of the photograph screen. The number of cells within the line is counted, and the average of the number of cells in the nine portions is determined. A cell that is in contact with the line 22 of one inch (25.4 mm) is counted as one cell even when the degree of contact with the line 22 is slight. For example, in the protecting agent supplying member shown in FIG. 4B, the number of cells is 12.

The hardness of the form layer is not particularly limited and may be appropriately selected depending on the intended purpose, but is preferably 50 N to 500 N, more preferably 100 N to 300 N. When the hardness is less than 50 N, the suppression of smear in the image bearer may be difficult. Also, when the hardness thereof is more than 500 N, the suppression of smear in the image bearer may be difficult. On the other hand, when the number of cells falls within more preferred range than the above-mentioned range, suppression of smear in the image bearer may be advantageously more excellent.

The hardness of the form layer is an average hardness measured at randomly selected 3 points on the surface of the foam layer based on JIS K 6400.

In the foam layer, the closed cell structure, the open cell structure, the number of cells, the hardness and the like can be regulated by appropriately selecting starting materials for the polyurethane foam, and appropriately adjusting the amount of the foaming agent, reaction conditions and the like in the production of the polyurethane foam.

The protecting agent supplying member can be produced by any process without particular limitation, and the production process may be appropriately selected depending on the intended purposes.

A production example wherein the polyurethane foam is used as a material for the foam layer will be explained as one example of a process for producing the protecting agent supplying member.

At the outset, starting materials for the polyurethane foam are subjected to foaming/curing by a conventional method to prepare a block-shaped polyurethane foam. The block is then taken off into a necessary shape, the surface thereof is polished, followed by machining into a cylindrical shape having cells open to the surface, and the core is inserted into the cylindrical shape. The core may be previously coated with an adhesive to enhance the adhesion between the core and the foam layer. The protecting agent supplying member is produced by these steps.

Other production examples will be explained. Starting materials for the polyurethane foam are introduced into a mold, for protective agent feeding member molding, in which the core is housed, followed by foaming/curing to produce the protecting agent supplying member.

In these production methods, the method for using the mold is preferable since producing a foam layer is performed at the same time as opening cells which are on the surface, and machining accuracy is favorably obtained.

In the production process using the mold, previously providing a release layer of a fluororesin coating agent or release agent on the surface in the mold is preferred, since complicated machining is unnecessary and the foam layer can have a suitable degree of opening.

<<Rubber Roller of Second Embodiment>>

The rubber roller of second embodiment includes a cored bar and a rubber layer on the cored bar, if necessary, includes other layers. Note that, the rubber roller may be a rubber roller which consists of only a rubber and has no cored bar.

—Cored Bar—

The shape, structure, size, and materials of the cored bar are not particularly limited and may be appropriately selected depending on the intended purpose. The shape thereof includes the cylindrical shape. The structure thereof may be a single layer structure or a layered structure. The size thereof may be appropriately selected depending on the size of the rubber roller and the like.

The materials of the cored bar are not particularly limited and may be appropriately selected depending on the intended purpose. The materials thereof may be appropriately selected from for example, carbon steel, alloyed steel, cast iron, and electroconductive resin may be used. Examples of the alloyed steel include stainless steel, nickel-chromium steel, nickel-chrome-molybdenum steel, chrome steel, and steel for nitriding by addition of Al, Cr, Mo, and V. Among them, the material made of metal is preferable from the viewpoint of strength. Also, the plating and oxidation treatment may be applied to the material of the cored bar as rust-preventive treatment. As the plating, both of an electroplating and an electroless plating may be used, however, the electroless plating is preferable from the viewpoint of dimension stability.

—Rubber Layer—

The structure, the size, and the materials of the rubber layer are not particularly limited and may be appropriately selected depending on the intended purpose. The structure thereof may be a single structure or a layered structure. The size thereof may be appropriately selected depending on the size of the rubber roller and the like.

The rubber layer contains a rubber component, and further contains other components, if necessary.

The rubber component is not particularly limited and may be appropriately selected depending on the intended purpose. Examples thereof include epichlorohydrin rubber, nitrilebutadiene-hydrin rubber, polyurethane rubber, silicone rubber, butadiene rubber, isoprene rubber, chloroprene rubber, styrene-butadiene rubber, ethylene-propylene rubber, polynorbornene rubber, fluororubber, and acrylic rubber. These may be used alone or in combination.

The aforementioned other components are not particularly limited and may be appropriately selected depending on the intended purpose. Examples thereof include softeners, processing aids, antioxidants, fillers, and reinforcing agents.

A method for producing the rubber layer is not particularly limited and may be appropriately selected depending on the intended purpose. The method for producing the rubber layer is described as follows. Ingredients for producing a rubber composition, and an additive to be added depending on the intended use are mixed using a kneader used for a general kneading such as a roll, Banbury mixer, and a kneader. A cored bar made of a metal as the supporting shaft is covered with the obtained rubber composition around the cored bar. Then, a rubber layer can be obtained by employing a method such as a press molding/vulcanization or an extrusion molding for molding a roller with an extruder. Then, in order to obtain desired size and uniform surface shape, if necessary, the surface of the rubber layer may be polished with a wet-type polisher, or a dry-type polisher using a whetstone.

The thickness of the rubber layer is not particularly limited and may be appropriately selected depending on the intended purpose. The thickness thereof is preferably, for example, from 1 mm to 10 mm.

<Protecting Agent Storage Member>

The protecting agent storage member is not particularly limited and may be appropriately selected depending on the intended purpose as long as a powdery image bearer protecting agent can be stored in a member. Examples thereof include a protecting agent storage case.

The size, shape, material, and structure of the protecting agent storage member are not particularly limited and may be appropriately selected depending on the intended purpose. Examples of the material include resins and metals. Examples of the resins include a polyethylene-telephthalate (PET) resin, a polypropylene resins, a polyethylene resin, a polycarbonate resin, a polyvinylchloride resin, ABS resin, FRP, and nylon. Examples of the metal include aluminium and stainless steel.

The size and shape of the protecting agent storage member are not particularly limited and may be appropriately selected depending on the intended purpose. The size and shape generally used are preferable.

The structure of the protecting agent storage member is preferably a single layer structure or two-layer structures.

An inner part of the protecting agent storage member may be separated or may be not separated. However, the inner part thereof is preferably separated since the powdery image bearer protecting agent can be stored without localized states.

A method for obtaining the desired number of partitions, where partition walls are formed by attaching the desired number of resin plates with an adhesive may be mentioned as a method for separating the inner part of the protecting agent storage member.

The thickness of the resin plates (partition walls) is preferably from 0.5 mm to 1.4 mm, more preferable is 1.0 mm.

Examples of the material of the resin plates (partition walls) include a polyethylene telephthalate (PET) resin, a polypropylene resin, a polyethylene resin, a polycarbonate resin, a polyvinyl chloride resin, ABS resin, FRP, and nylon.

The number of the partitions of the protecting agent storage member is preferably from 5 to 15, more preferably from 10 to 15. When the number thereof is less than 5, an effect of preventing a localized state of the powdery image bearer protecting agent stored in the protecting agent storage member can not be obtained. When the number thereof is more than 15, difference of preventing a localized state of the powdery image bearer protecting agent stored in the protecting agent storage member can not be observed and it takes a long time to produce partition walls.

Figure 5A:
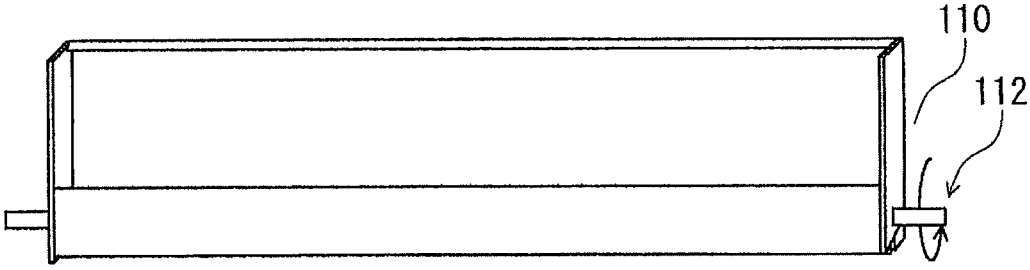
FIG. 5A is a schematic cross-sectional view illustrating one example of a protecting agent storage member where a powdery image bearer protecting agent is stored.
Figure 5B:
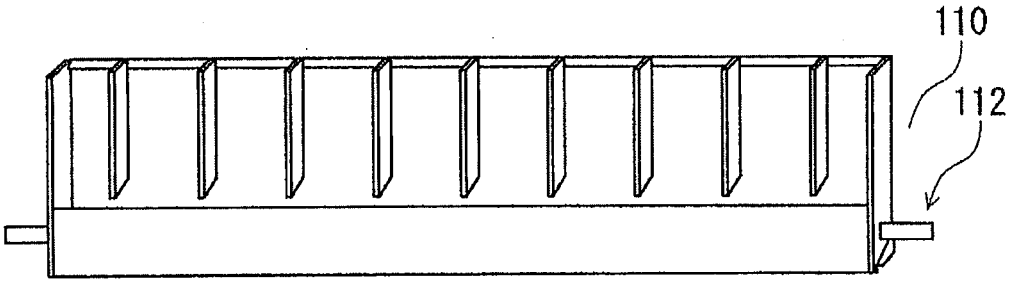
FIG. 5B is a schematic cross-sectional view illustrating one example of a protecting agent storage member which stores a powdery image bearer protecting agent in partitions thereof.
Figure 5C:
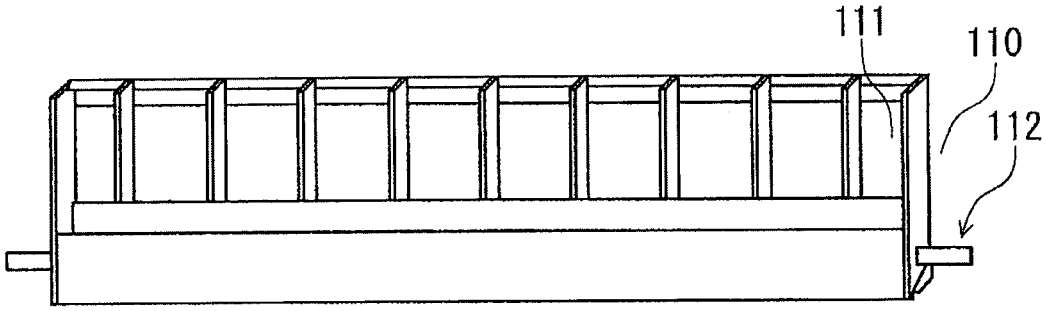
FIG. 5C is a schematic cross-sectional view illustrating one example of a state where the powdery image bearer protecting agent is filled in partitions in the protecting agent storage member shown in FIG. 5B.

FIG. 5A is a schematic diagram illustrating one example of a protecting agent storage member where the inner part of the protecting agent storage member is not separated. FIG. 5B is a schematic diagram illustrating one example of a protecting agent storage member where the inner part of the protecting agent storage member is separated into 10 partition walls. FIG. 5C is a schematic diagram illustrating a state where powdery image bearer protecting agent is filled in the separated protecting agent storage member shown in FIG. 5B.

The regulating member is preferably arranged upstream of or before a place where a roller roller-shaped protecting agent supplying member abuts on an image bearer.

The powdery protecting agent storage member can prevent protecting agent particles from excessively supplying, which is described as follows. Protecting agent particles which are transferred from the protecting agent supplying member and adhere to the protecting agent supplying member, and can be scraped off by allowing to pass through a regulating member.

The regulating member is not particularly limited. Examples thereof include a member of resins such as polyethylene telephthalate (PET) and polypropylene (PP), which are generally used; a member of rubbers such as a urethane rubber, a hydrin rubber, a silicone rubber, and a fluoro rubber; and a member of a metal such as SUS.

In a regulating member made of resins such as polyethylene telephthalate (PET) and polypropylene (PP), the thickness of the regulating member is, depending on the materials thereof, preferably from 0.1 mm to 0.5 mm, more preferably from 0.1 mm to 0.25 mm from the viewpoint of abrasion of a supplying roller.

In a regulating member made of rubbers such as a urethane rubber, a hydrin rubber, a silicone rubber, and a fluoro rubber, the thickness of the regulating member is, depending on the materials thereof, preferably from 0.5 mm to 3 mm, more preferably from 0.5 mm to 1 mm from the viewpoint of force of damming as a regulating member.

The material of the metal is, the thickness of the regulating member is, depending on the materials thereof, preferably from 0.1 mm to 0.5 mm, more preferably from 0.1 mm to 0.2 mm from the viewpoint of abrasion of a supplying roller.

<Protective Layer Forming Member>

The protective layer forming member is not particularly limited and may be appropriately selected depending on the intended purpose as long as the protective layer forming member is a protective layer forming member which make a powdery image bearer protecting agent thinner and can form a protective layer. Examples thereof include a blade.

The material of the blade is not particularly limited and may be appropriately selected depending on the intended purpose. Examples thereof include a urethane rubber, a hydrin rubber, a silicone rubber, and a fluoro rubber. These may be used alone or in combination.

The blade in its portion in contact with the image bearer may be coated with or impregnated with a material having a low coefficient of friction. Further, fillers such as organic fillers or inorganic fillers may be dispersed therein to regulate the hardness of the blade.

The blade is fixed to a blade support by any method such as bonding or fusion so that the front portion can be pressed and abutted against the surface of the image bearer.

The thickness of the blade is not particularly limited, and cannot be unequivocally specified since a relationship with a pressing force should be taken into consideration, the thickness is preferably 0.5 mm to 5 mm, more preferably 1 mm to 3 mm.

Likewise, although the length of the blade that is protruded from the blade support and can be bent, the so-called free length, cannot be unequivocally specified since a relationship with a pressing force should be taken into consideration, the length is preferably 1 mm to 15 mm, more preferably 2 mm to 10 mm.

An example of other construction of the protective layer forming member is a construction obtained by forming a covering layer of a resin, a rubber, or an elastomer by a coating, dipping or other method on the surface of an elastic metal blade such as a spring sheet, if necessary, for example, through a coupling agent or a primer component, if necessary, heat curing the coating and, if necessary, subjecting the coating to surface polishing or the like.

The covering layer contains a binder resin and a filler and, further if necessary, other ingredients.

The binder resin is not particularly limited and may be appropriately selected depending on the intended purpose. Examples of the binder resin include a fluororesin such as perfluoroalkoxyalkane (PFA), polytetrafluoroethylene (PTFE), tetrafluoroethylene-hexafluoropropylene copolymer (FEP), and polyvinylidene chloride (PVdF); and a silicone elastomer such as a fluoro rubber and a methylphenylsilicone elastomer.

The thickness of the resilient metal blade is not particularly limited and may be appropriately selected depending on the intended purpose, but is preferably 0.05 mm to 3 mm, more preferably 0.1 mm to 1 mm. After being attached, the elastic metal blade can be bended in a direction almost parallel to a support shaft so as to prevent the metal blade from twisting.

The pressing force of the protective layer forming member against the image bearer is not particularly limited and may be appropriately selected depending on the intended purpose. The pressing force thereof is sufficient as long as the image bearer protecting agent spreads into the protective layer. A linear pressure is not particularly limited and may be appropriately selected depending on the intended purpose, but is preferably 5 gf/cm to 80 gf/cm, more preferably 10 gf/cm to 60 gf/cm.

The protective layer forming member may serves also as a cleaning member. In order to more reliably form a protective layer, however, preferably, a residue composed mainly of the toner on the image bearer is previously removed by a cleaning member to avoid the entry of the residue into the protective layer.

A protective layer forming device of the present invention will be described with reference to FIGS. 6A and 6B.

Figure 6A:
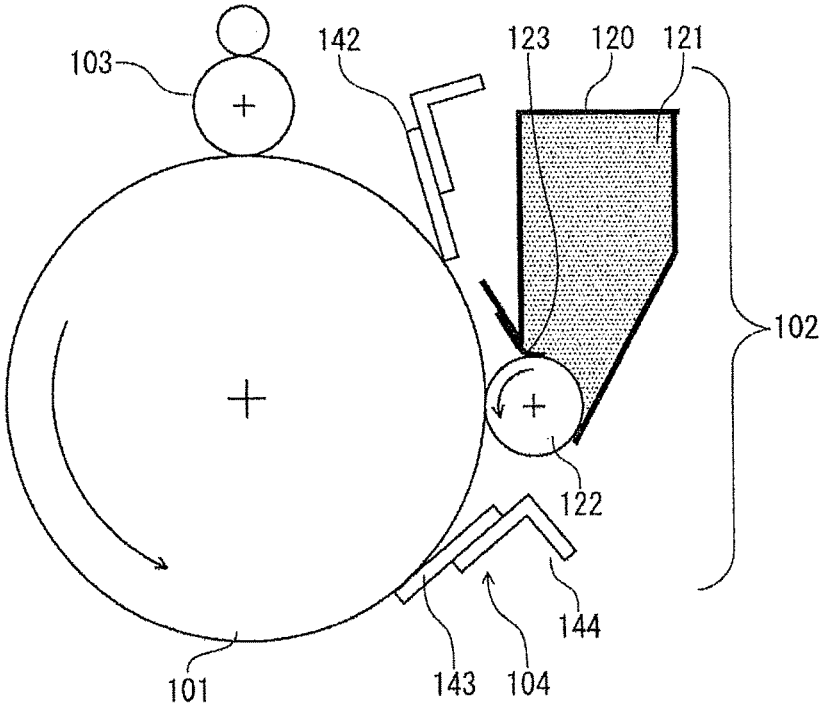
FIG. 6A is a schematic cross-sectional view illustrating one example of a protective layer forming device in an image forming apparatus of the present invention, and shows an exemplary case where a regulating member is disposed to abut on the protecting agent supplying member in an opposite (counter) direction to a rotational direction thereof.
Figure 6B:
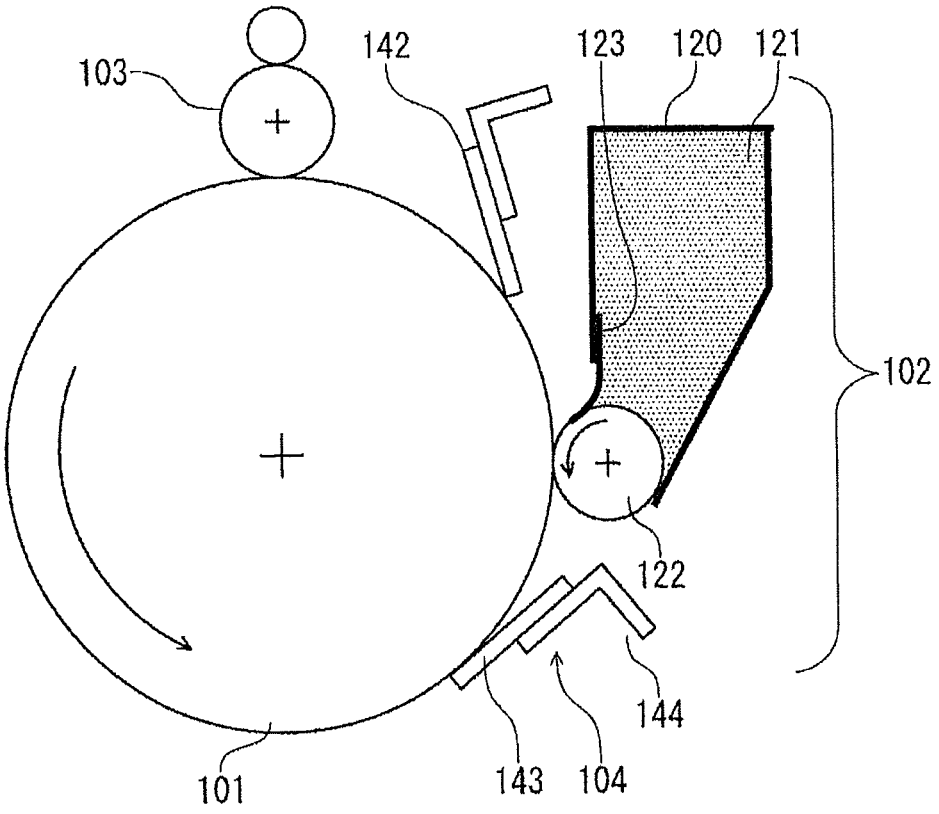
FIG. 6B is a schematic cross-sectional view illustrating one example of a protective layer forming device in an image forming apparatus of the present invention, and shows an exemplary case where a regulating member is disposed to abut on the protecting agent supplying member in a forward (trading) direction to a rotational direction thereof.

FIGS. 6A and 6B are schematic cross-sectional views illustrating one example of a protective layer forming device in an image forming apparatus of the present invention. FIG. 6A shows an exemplary case where a regulating member is disposed to abut on a protecting agent supplying member in an opposite (counter) direction to a rotational direction thereof. FIG. 6B shows an exemplary case where a regulating member is disposed to abut on a protecting agent supplying member in a forward (trading) direction to a rotational direction thereof.

A protective layer forming device 102 disposed in an opposite direction to a photoconductor drum 101 as the image bearer contains a roller-shaped protecting agent supplying member 122; a regulating member 123, which regulates the powdery image bearer protecting agent provided by the roller-shaped protecting agent supplying member 122; a protecting agent storage member 120, which stores a powdery image bearer protecting agent 121; and a protective layer forming member 142.

The roller-shaped protecting agent supplying member 122 and the photoconductor drum 101 rotate at different liner velocities. The powdery image bearer protecting agent 121 stored in the protecting agent storage member 120 is held on the surface of the roller-shaped protecting agent supplying member 122. In this state, the powdery image bearer protecting agent 121 is rubbed with the photoconductor drum 101 and is provided onto the surface of the photoconductor drum 101.

There is such a case that the powdery image bearer protecting agent 121 provided onto the surface of the photoconductor drum 101 does not form satisfactory protective layer depending on the species of materials when the powdery image bearer protecting agent 121 is supplied. Accordingly, in order to form more homogeneous protective layer, for example, a thinner protective layer may be formed using a blade-shaped protective layer forming member 142.

As the image bearer, the photoconductor drum 101 on which the protective layer has been formed is charged by, for example, coming into contact with or approaching a charging roller 103 to which direct current or direct current superimposed with alternate current has been applied from a high-voltage power source (not shown) to thereby cause discharge at a microgap therebetween. During charging, a part of the protective layer is decomposed or oxidized by electrical stress. Further, air discharge products are adhered to the surface of the protective layer.

The deteriorated image bearer protecting agent is removed, by a conventional cleaning mechanism, along with other ingredients such as a toner remaining on the image bearer 1. The cleaning mechanism can also function as the protective layer forming member 142. However, a sliding condition suitable for removing a residue remaining on the surface of the photoconductor drum may be different from that of for forming the protective layer. Thus, preferably, the functions are separated, and, as shown in FIGS. 6A and 6B, a cleaning apparatus 104 containing a cleaning blade 143 and a cleaning pressing mechanism 144 is provided on an upstream side of protective layer forming device 102.

(Image Forming Method and Image Forming Apparatus)

The image forming method used in the present invention includes a electrostatic latent image forming step, a developing step, a transfer step, and a protective layer forming step; preferably includes a cleaning step and a fixing step, and, if necessary, further includes appropriately selected other steps such as a charge-eliminating step, a recycling step, and a control step.

The image forming apparatus of the present invention includes at a least an image bearer, a electrostatic latent image forming unit, a developing unit, a transfer unit, and a protective layer forming unit; preferably includes a cleaning unit and a fixing unit; and, if necessary, further includes appropriately selected other units such as a charge eliminating unit, a recycling unit, and a control unit.

The image forming method used in the present invention can be suitably performed by the image forming apparatus of the present invention, the electrostatic latent image forming step can be performed by the electrostatic latent image forming unit, the developing step can be performed by the developing unit, the transfer step can be performed by the transfer unit, the protective layer forming step can be performed by the protective layer forming unit, the cleaning step can be performed by the cleaning unit, the fixing step can be performed by the fixing unit, and the other steps can be performed by the other units.

<Electrostatic Latent Image Forming Step and Electrostatic Latent Image Forming Unit>

The electrostatic latent image forming step is a step of forming a electrostatic latent image on an image bearer and can be performed by a electrostatic latent image forming unit.

—Image Bearer—

For the image bearer (hereinafter referred to as "photoconductor" or "electrophotographic photoconductor"), the material, shape, structure, size and the like are not particularly limited and may be appropriately selected from conventional ones. A drum shape is suitable as the shape of the image bearer. Examples of a material for the image bearer include an inorganic photoconductor such as amorphous silicon and selenium and an organic photoconductor such as polysilane and phthalopolymethine.

The image bearer contains an electroconductive support, at least a photosensitive layer provided on the electroconductive support and, further if necessary, includes other layers.

The photosensitive layer is a single layer photosensitive layer containing a charge generating material and a charge transport material that are present as a mixture, a laminate photosensitive layer containing a charge transport layer provided on a charge generating layer, or a reverse laminate photosensitive layer containing a charge generating layer provided on a charge transport layer. An uppermost layer may also be provided on the photosensitive layer to improve mechanical strength, abrasion resistance, gas proofness, cleaning properties and the like of the photoconductor. An undercoating layer may be provided between the photosensitive layer and the electroconductive support.

Further, if necessary, plasticizers, antioxidants, leveling agents and the like may also be added in a suitable amount to the layers.

The electroconductive support is not particularly limited as long as it has an electrical conductivity of $1.0\times10^{10}$ Ω·cm or less in terms of volume resistance value. The electroconductive support may be appropriately selected depending on the intended purposes. Examples thereof include products obtained by covering a metal such as aluminium, nickel, chromium, NICHROME, copper, gold, silver, or platinum, or a metal oxide such as tin oxide or indium oxide by vapor deposition or sputtering on film-like or cylindrical plastic or paper, or aluminium, aluminium alloy, nickel, stainless steel or other plates and pipes obtained by subjecting the plates to extrusion, drawing or the like to prepare element tubes and then subjecting the element tubes to cutting, super finishing, polishing or the like.

The diameter of the drum-shaped support is not particularly limited and may be appropriately selected depending on the intended purpose. The diameter thereof is preferably 20 mm to 150 mm, more preferably 24 mm to 100 mm, still more preferably 28 mm to 70 mm. When the diameter of the drum-shaped support is less than 20 mm, the arrangement of charging, exposure, development, transfer, and cleaning steps around the drum is likely to be physically difficult. On the other hand, when the diameter of the drum-shaped support is greater than 150 mm, disadvantageously, the size of the image forming apparatus is likely to get bigger. In particular, when the image forming apparatus is of a tandem type, a plurality of photoconductors should be loaded. Accordingly, the diameter is preferably 70 mm or less, more preferably 60 mm or less. Further, endless nickel belts or endless stainless steel belts as disclosed in JP-A No. 52-36016 are also usable as the electroconductive support.

The undercoating layer of the photoconductor may have a single-layer structure or a multilayer structure of two or more layers. Examples of undercoating layers include (1) a layer composed mainly of a resin, (2) a layer composed mainly of a white pigment and a resin, and (3) a metal oxide film formed by chemically or electrochemically oxidizing a surface of an electroconductive base. Among them, a layer composed mainly of a white pigment and a resin is preferred.

Examples of the white pigment include metal oxides such as titanium oxide, aluminium oxide, zirconium oxide, and zinc oxide. Among them, titanium oxide is particularly preferred as it can well prevent injection of charges from the electroconductive support.

Examples of the resin include thermoplastic resins such as polyamide, polyvinyl alcohol, casein, and methylcellulose; and thermoset resins such as acryl, phenol, melamine, alkyd, an unsaturated polyester resin, and epoxy. These may be used alone or in combination.

The thickness of the undercoating layer is not particularly limited and may be appropriately selected depending on the intended purpose but is preferably 0.1 μm to 10 μm, more preferably 1 μm to 5 μm.

Examples of a charge generating substance for use in the photosensitive layer include: an azo-pigment such as a monoazo pigment, a bisazo pigment, a trisazo pigment, and a tetrakisazo pigment; an organic pigment or dye such as a triarylmethane dye, a thiazine dye, an oxazine dye, a xanthene dye, a cyanine dye, a styryl dye, a pyrylium dye, a quinacridone pigment, an indigo pigment, a perylene pigment, a polycyclic quinone pigment, a bisbenzimidazole pigment, an indanthrone pigment, a squarylium pigment, and a phthalocyanine pigment; and an inorganic material such as selenium, selenium-arsenic, selenium-tellurium, cadmium sulfide, zinc oxide, titanium oxide, and amorphous silicon. These may be used alone or in combination.

Examples of a charge transport substance for use in the photosensitive layer include anthracene derivatives, pyrene derivatives, carbazole derivatives, tetrazole derivatives, metallocene derivatives, phenothiazine derivatives, a pyrazoline compound, a hydrazone compound, a styryl compound, a styrylhydrazone compound, an enamine compound, a butadiene compound, a distyryl compound, an oxazole compound, an oxadiazole compound, a thiazole compound, an imidazole compound, triphenyl amine derivatives, phenylene-diamine derivatives, aminostilbene derivatives, and triphenylmethane derivatives. These may be used alone or in combination.

Examples of a binder resin used for forming the photosensitive layer include a thermoplastic resin, a thermoset resin, a photocurable resin, and a photoconductive resin, all of which are electrically insulative and are known in the art. Examples of such the resins include: a thermoplastic resin such as polyvinyl chloride, polyvinylidene chloride, vinyl chloride-vinyl acetate copolymer, vinyl chloride-vinyl acetate-maleic anhydride copolymer, ethylene-vinyl acetate copolymer, polyvinyl butyral, polyvinyl acetal, polyester, phenoxy resin, (meth)acrylic resin, polystyrene, polycarbonate, polyallylate, polysulfone, polyether sulfone, and ABS resins; and a thermoset resin such as a phenolic resin, an epoxy resin, a urethane resin, a melamine resin, an isocyanate resin, an alkyd resin, a silicone resin, and a heat curable acrylic resin; and others such as polyvinyl carbazole, polyvinyl anthracene, and polyvinyl pyrene. These may be used alone or in combination.

The uppermost surface layer of the photoconductor is provided in order to improve mechanical strength, abrasion resistance, gas proofness, and cleaning properties of the photoconductor.

The uppermost surface layer formed of a polymer having a higher mechanical strength than the photosensitive layer or a dispersion of an inorganic filler in a polymer is suitable. The resin used in the uppermost surface layer may be any of a thermoplastic resin and a heat curable resin. The heat curable resin is particularly preferred because of high mechanical strength and a very high capability of suppressing abrasion by friction against the cleaning blade. Even though the uppermost surface layer has no charge transport capacity, no problem occurs when the thickness of the uppermost surface layer is small. When the surface layer having no charge transport capacity is formed thick, a lowering in sensitivity of the photoconductor, a rise in potential after exposure, and a rise in residual potential are likely to occur. Accordingly, the incorporation of the above charge transport substance in the uppermost surface layer or the use of a polymer having a charge transport capacity as the polymer used in the uppermost surface layer is preferred.

The photosensitive layer and the uppermost surface layer are generally significantly different from each other in mechanical strength. Accordingly, when the uppermost surface layer is abraded by friction against the cleaning blade and disappears, the photosensitive layer is soon abraded. Therefore, when the uppermost surface layer is provided, it is preferable that the uppermost surface layer has a satisfactory thickness. The thickness of the uppermost surface layer is not particularly limited and may be appropriately selected depending on the intended purpose. The thickness of the uppermost surface layer is preferably from 0.1 μm to 12 μm, more preferably from 1 μm to 10 μm, particularly preferably from 2 μm to 8 μm. When the thickness is less than 0.1 μm, due to excessively small thickness, the uppermost surface layer is likely to partially disappear by friction against the cleaning blade and the abrasion of the photosensitive layer is likely to proceed from the disappeared portion. On the other hand, when the thickness of the uppermost surface layer is greater than 12 μm, a lowering in sensitivity, a rise in potential after exposure, and a rise in residual potential are likely to occur. In particular, when a polymer having a charge transport capacity is used, the cost of the polymer having a charge transport capacity is disadvantageously likely to increase.

The resin used in the uppermost surface layer is not particularly limited and is preferably transparent to writing light in image formation and has excellent insulation, mechanical strength, and adhesion, and examples thereof include ABS resins, ACS resins, olefin-vinyl monomer copolymers, chlorinated polyethers, allyl resins, phenolic resins, polyacetals, polyamides, polyamide-imides, polyacrylates, polyallylsulfones, polybutylenes, polybutylene terephthalates, polycarbonates, polyether sulfones, polyethylenes, polyethylene terephthalates, polyimides, acrylic resins, polymethylpentene, polypropylenes, polyphenylene oxides, polysulfones, polystyrenes, AS resins, butadiene-styrene copolymers, polyurethanes, polyvinyl chlorides, polyvinylidene chlorides, and epoxy resins. These polymers may be thermoplastic resins. In order to enhance mechanical strength of the polymer, however, the polymers may be crosslinked with a crosslinking agent containing polyfunctional acryloyl, carboxyl, hydroxyl, amino or other group to produce heat curable resins. The use of the heat curable resins can increase the mechanical strength of the uppermost surface layer and can significantly reduce abrasion by friction against the cleaning blade.

The uppermost surface layer preferably has a charge transport capacity. Examples of possible methods for imparting a charge transport capacity to the uppermost surface layer include a method in which the polymer used in the uppermost surface layer is mixed with the charge transport substance and a method in which a polymer having a charge transport capacity is used in the uppermost surface layer. The latter method is preferred since a photoconductor that has high sensitivity and is less likely to cause a rise in potential after exposure and a rise in residual potential can be obtained.

Preferably, the uppermost surface layer contains metallic fine particles, metal oxide fine particles, or other fine particles from the viewpoint of enhancing the mechanical strength of the uppermost surface layer. Examples of metal oxides include titanium oxide, tin oxide, potassium titanate, titanium nitride, zinc oxide, indium oxide, and antimony oxide. Examples of other fine particles include fluoro resins such as polytetrafluoroethylene, silicone resins, and a dispersion of an inorganic material in these resins that are used from the viewpoint of improving abrasion resistance.

A electrostatic latent image can be formed, for example, by charging the surface of the image bearer and then imagewise-exposing the surface with the electrostatic latent image forming unit. The electrostatic latent image forming unit includes at least a charger configured to charge the surface of the image bearer, and an exposing device configured to imagewise-expose the surface of the image bearer.

The charging can be performed by applying a voltage to the surface of the image bearer using, for example, the charger.

The charger is not particularly limited and may be appropriately selected depending on the intended purpose. Examples thereof include contact chargers known in the art which are equipped with, for example, an electroconductive or semi-electroconductive roller, a brush, a film, or a rubber blade; and non-contact chargers utilizing corona discharge such as corotron and scorotron.

The charger preferably includes a voltage applying unit configured to apply voltage having an alternate current component.

The exposing can be performed by imagewise-exposing the surface of the image bearer using the exposing device.

The exposing device is not particularly limited and may be appropriately selected depending on the intended purpose, as long as it can imagewise-expose the surface of the image bearer which has been charged by the charger. Examples thereof include exposing devices such as copying optical systems, rod lens array systems, laser optical systems, and liquid crystal shutter optical systems.

In the present invention, a back exposure method may be adopted in which image-wise exposure is carried out from the backside of the image bearer.

<Developing Step and Developing Unit>

The developing step is a step of developing the electrostatic latent image with a toner or a developer to form a visible image.

The visible image may be formed, for example, by developing the electrostatic latent image with the toner or the developer, and the development may be carried out by the developing unit.

The developing unit is not particularly limited as long as, for example, the development can be carried out with the toner or the developer. The developing unit may be properly selected from conventional ones. A suitable example of the developing unit contains at least, for example, a developing device that contains the toner or the developer and can apply the toner or the development agent to the electrostatic latent image in a contact or non-contact manner.

<<Toner>>

The toner is not particularly limited and may be appropriately selected depending on the intended purpose. An example of the toner is one prepared by subjecting a toner composition containing a polyester prepolymer having a nitrogen atom-containing functional group, a compound that can cause an elongation or crosslinking reaction with the prepolymer, a polyester, a colorant, and a release agent in an aqueous medium in the presence of resin fine particles to elongation or crosslinking reaction. By curing the surface of this toner, it is possible to reduce hot offset and prevent smear from occurring on the image in the fixing device.

An isocyanate group-containing polyester prepolymer may be mentioned as the polyester prepolymer having a nitrogen atom-containing functional group, and amines may be mentioned as the compound that cause an elongation or crosslinking reaction with the prepolymer.

A product obtained by further reacting a polyester, which is a condensate of a polyol with a polycarboxylic acid and has an active hydrogen group, with a polyisocyanate may be mentioned as the polyester prepolymer having an isocyanate group. Examples of active hydrogen groups possessed by the polyester include a hydroxyl group (an alcoholic hydroxyl group and a phenolic hydroxyl group), an amino group, a carboxyl group, and a mercapto group. Among them, the alcoholic hydroxyl group is particularly preferred.

The polyol is not particularly limited and may be appropriately selected depending on the intended purpose, and examples thereof include diols and trivalent or higher polyols. Among them, a diol alone or a mixture of a diol with a small amount of a trivalent or higher polyol is preferred.

The polycarboxylic acid is not particularly limited and may be appropriately selected depending on the intended purpose, and examples thereof include dicarboxylic acids and trivalent or higher polycarboxylic acids. Among them, a dicarboxylic acid alone or a mixture of a dicarboxylic acid with a small amount of a trivalent or higher polycarboxylic acid is preferred.

The ratio of the polyol to the polycarboxylic acid is not particularly limited and may be appropriately selected depending on the intended purpose. The ratio thereof is preferably 2/1 to 1/1, more preferably 1.5/1 to 1/1, still more preferably 1.3/1 to 1.02/1, in terms of the equivalent ratio of the hydroxyl group [OH] to the carboxyl group [COOH], i.e., [OH]/[COOH].

Examples of the polyisocyanate include: aliphatic polyisocyanate (e.g., tetramethylene diisocyanate, hexamethylene diisocyanate, and 2,6-diisocyanate methyl caproate); alicyclic polyisocyanate (e.g., isophorone diisocyanate, and cyclohexylmethane diisocyanate); aromatic diisocyanate (e.g., tolylenediisocyanate, diphenylmethane diisocyanate); aromatic aliphatic diisocyanate (e.g., $\alpha,\alpha,\alpha',\alpha'$-tetramethylxylylene diisocyanate); isocyanurate; and products obtained by blocking the polyisocyanates with phenol derivatives, oximes, caprolactams or the like. These may be used alone or in combination.

Regarding the ratio of the polyisocyanate, the equivalent ratio between the isocyanate group [NCO] and the hydroxyl group [OH] of polyester having a hydroxyl group, i.e., [NCO]/[OH], is not particularly limited and may be appropriately selected depending on the intended purpose. The aforementioned equivalent ratio is preferably 5/1 to 1/1, more preferably 4/1 to 1.2/1, still more preferably 2.5/1 to 1.5/1. When the ratio [NCO]/[OH] is greater than 5, low-temperature fixation is deteriorated. On the other hand, when the molar ratio of [NCO] is less than 1, the content of urea in modified polyester is so low that hot offset resistance is deteriorated.

Examples of the amine include diamine, trivalent or higher polyamine, amino alcohol, aminomercaptan, amino acid, and products obtained by blocking amino group in any of these amines. Among them, diamine or mixtures of diamine with trivalent or higher polyamine are preferred.

Further, if necessary, the molecular weight of urea modified polyester can be regulated with an elongation terminator. Elongation terminators include monoamines (e.g., diethylamine, dibutylamine, butylamine, and laurylamine) or products obtained by blocking the monoamines (e.g., ketimine compounds).

Further, in the image forming method and the image forming apparatus, not only a polymerization method toner having a construction suitable for the provision of high-quality images but also a toner having irregular shapes obtained by a polishing method can be applied. Also in this case, the service life of the apparatus can be significantly prolonged. Materials commonly usable as an electrophotographic toners can be applied as materials constituting the toner obtained by the polishing method without particular limitation.

The developing device may be of a dry development type or a wet development type, or a single-color developing device or a multi-color developing device. For example, a developing device containing an agitator, which performs friction agitation of the toner or the developer for charging, and a rotatable magnet roller is suitable.

For example, the toner and the carrier are mixed and agitated within the developing device. At that time, the toner is electrified by friction and is held in a napping state on the surface of the magnet roller being rotated to form a magnetic brush. Since the magnet roller is disposed near the image bearer, a part of the toner constituting the magnetic brush formed on the surface of the magnet roller is travelled to the surface of the image bearer by electrical attraction. As a result, the electrostatic latent image is developed with the toner to form a visible image of the toner on the surface of the image bearer.

The developer stored in the developing device is a developer containing the toner. The developer may be a one-component developer or a two-component developer.

<Transfer Step and Transfer Unit>

The transfer step is a step of transferring the visible image onto a recording medium. Preferably, the visible image is primarily transferred onto the intermediate transfer member and then the visible image is secondarily transferred onto the recording medium. More preferably, two or more color toners, preferably full-color toners are used, the transfer step includes a primary transfer step of transferring the visible image onto the intermediate transfer member to form a composite transfer image thereon, and a secondary transfer step of transferring the composite transfer image onto a recording medium.

The transferring can be performed, for example, by charging the visible image formed on the image bearer using a transfer-charger, and can be performed by the transfer unit. The transfer step preferably includes a primary transfer step of transferring the visible image onto the intermediate transfer member to form a composite transfer image thereon, and a secondary transfer step of transferring the composite transfer image onto a recording medium.

The intermediate transfer member is not particularly limited and may be appropriately selected from those known in the art depending on the intended purpose. Example thereof includes a transfer belt.

The image bearer may be an intermediate transfer medium used in image formation by the so-called intermediate transfer method in which a toner image formed on a photoconductor is transferred by primary transfer to perform color superimposition, followed by transfer onto a recording medium.

<<Intermediate Transfer Medium>>

The intermediate transfer member preferably has volume resistivity of $1.0\times10^{5}$ Ω·cm to $1.0\times10^{11}$ Ω·cm. When the volume resistivity is less than $1.0\times10^{5}$ Ω·cm, so-called transfer dust particles are likely to be caused, i.e., the resulting toner images become unstable due to discharge generated when the toner images are transferred onto the intermediate transfer medium from the photoconductor. When the volume resistivity is more than $1.0\times10^{11}$ Ω·cm, a charge counter to that held on the toner images remain on the intermediate transfer member after the toner image are transferred onto a transfer medium therefrom, which may cause image lag (a residual image) on a subsequently processed image.

The intermediate transfer medium may be a belt type or cylindrical plastic obtained, for example, by kneading metal oxides such as tin oxide or indium oxide, electroconductive particles such as carbon black, or electroconductive polymers (either alone or in combination) with a thermoplastic resin and extruding the kneaded product. In addition, an endless belt type intermediate transfer medium can also be obtained by optionally adding the above electroconductive particles or electroconductive polymers to a resin liquid containing a heat crosslinkable monomer or oligomer and centrifugally molding the resin liquid with heating.

In providing a surface layer on the intermediate transfer medium, a composition containing materials for the surface layer used in the surface layer of the photoconductor except for the charge transport material is appropriately used in combination with the electroconductive substance to perform resistance adjustment before use of the composition.

The transferring unit (the primary transferring unit and the secondary transferring unit) preferably contains at least a transfer device that separates and electrifies the visible image formed on the image bearer for transfer to the recording medium side. The number of transferring units used may be either one or two or more. Examples of transfer devices include corona transfer devices by corona discharge, transfer belts, transfer rollers, pressure transfer rollers, and pressure-sensitive transfer devices.

The recording medium is not particularly limited and may be properly selected from conventional recording media (recording papers).

<Protective Layer Forming Step and Protective Layer Forming Unit>

The protective layer forming step is a step of applying a image bearer protecting agent onto the surface of the image bearer after transfer to form a protective layer.

The protective layer forming apparatus according to the present invention described above may be used as the protective layer forming unit.

The fixing step is a step of fixing the visible image transferred onto the recording medium by the fixing unit. The fixing step may be carried out every time when each color toner is transferred onto the recording medium, or alternatively, may be carried out at a time in such a state that the color toners are stacked on top of each other.

The fixing unit is not particularly limited and may be appropriately selected according to purposes. However, conventional heating/pressing units are suitable. Heating/pressing units include a combination of a heating roller with a pressure roller and a combination of a heating roller with a pressure roller and an endless belt.

In general, heating in the heating/pressing unit is preferably 80° C. to 200° C.

In the present invention, according to purposes, for example, a conventional photofixing device may be used together with or instead of the fixing step and the fixing unit.

<Cleaning Step and Cleaning Unit>

The cleaning step is a step of removing the toner that stays on the image bearer and can be suitably carried out by a cleaning unit.

The cleaning unit is preferably provided at a position that is on the downstream side of the transferring unit and is on the upstream side of the protective layer forming unit.

The cleaning unit is not particularly limited as long as it can remove the electrophotographic toner that stays on the image bearer. The cleaning unit can be properly selected from conventional cleaners. Examples of suitable cleaners include magnetic brush cleaners, electrostatic brush cleaners, magnetic roller cleaners, blade cleaners, brush cleaners, and web cleaners.

<Other Steps and Other Units>

Examples of the other steps include a diselectrification step, a recycling step, and a control step.

Examples of the other units include a diselectrification unit, a recycling unit, and a control unit.

—Discharging Step and Discharging Unit—

The discharging step is a step of applying a discharging bias to the image bearer to perform discharging and can be suitably carried out by a discharging unit.

The discharging unit is not particularly limited as far as it can apply a discharging bias to the image bearer and may be properly selected from conventional discharging devices. Examples of suitable discharging devices include discharging lamps.

—Recycling Step and Recycling Unit—

The recycling step is a step of recycling the toner removed by the cleaning step to the developing unit and can be suitably carried out by a recycling unit.

The recycling unit is not particularly limited and may be a conventional conveying unit.

—Control Step and Control Unit—

The control step is a step of controlling each of the steps and can be suitably carried out by a control unit.

The control unit is not particularly limited as long as the movement of each of the units can be controlled. The control unit may be appropriately selected depending on the intended purpose, and examples thereof include equipment such as sequencers and computers.

Figure 7:
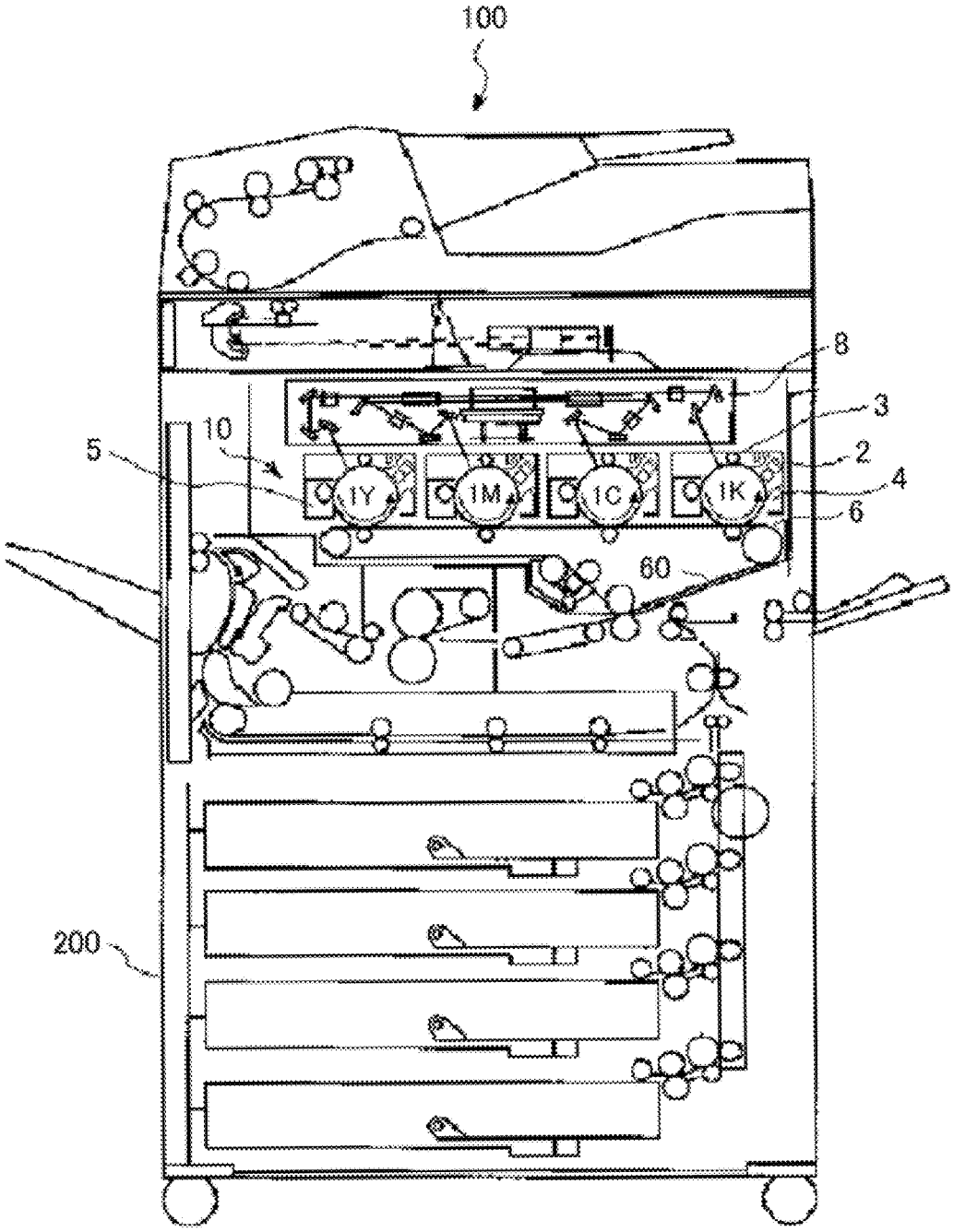
FIG. 7 is a schematic diagram illustrating one example of an image forming apparatus of the present invention

FIG. 7 is a schematic diagram illustrating one example of the image forming apparatus of the present invention. In the image forming apparatus 100, a protective layer forming device 2, a charging device 3, a latent image forming device 8, a developing device 5, a transferring device 6, and a cleaning device 4 are arranged around drum-shaped image bearers 1Y, 1M, 1C, 1K, and an image is formed by the following operation.

Hereinafter, an image forming process using negative/positive process will be described.

An image bearer typified by an organic photoconductor (OPC) having an organic photoconductive layer is neutralized with a discharging lamp (not shown) or the like and is uniformly negatively electrified with a charging device 3 which has a charging member.

In the charging of the image bearer by the charging unit, a voltage having a suitable intensity or an electrified voltage obtained by superimposing an alternating current voltage on the voltage, which is suitable for the charging of image bearers 1Y, 1M, 1C, 1K to a desired potential is applied to a charging member from a voltage applying mechanism (not shown).

In the electrified image bearers 1Y, 1M, 1C, 1K, a latent image is formed by laser beams applied by a latent image forming device 8 such as a laser optical system (the absolute value of the potential in exposed areas being lower than the absolute value of the potential in non-exposed areas).

Laser beams are emitted from a semiconductor laser and scan the surface of the image bearers 1Y, 1M, 1C, 1K in a direction of rotational axis of the image bearers, for example, by a polygonal columnar polygonal mirror (polygon) being rotated at a high speed.

The latent image thus formed is developed with a toner supplied on a developing sleeve which is a developer support in the developing unit 5, or a development agent composed of a mixture of toner and carrier particles to form a toner visible image.

In the development of the latent image, a voltage having a suitable intensity or a development bias obtained by superimposing an alternating current voltage on the voltage, which is present between exposed areas and non-exposed areas in the image bearers 1Y, 1M, 1C, 1K is applied to the developing sleeve from the voltage applying mechanism (not shown).

Toner images formed on the image bearers 1Y, 1M, 1C, 1K corresponding to respective colors are transferred onto an intermediate transfer medium 60 by a transferring device 6, and the toner images are transferred onto a recording medium such as paper fed from a paper feeding mechanism 200.

At that time, preferably, a potential having a polarity opposed to a polarity of the toner charging is applied as a transfer bias to the transferring device 6. Thereafter, the intermediate transfer medium 60 is separated from the image bearers to obtain a transferred image.

The toner that stays on the image bearers is collected by a cleaning member and is recovered into a toner recovery chamber within the cleaning device 4.

The image forming apparatus may be an apparatus containing a plurality of developing devices of the type described above. The image forming apparatus may be such that a plurality of toner images that are different from each other in color and have been successively prepared by the plurality of developing devices are successively transferred onto a recording member and the recording member is then transferred onto a fixation mechanism where the toners are fixed by heat or the like. Alternatively, the image forming apparatus may be such that a plurality of toner images prepared in the same manner as described above are successively once transferred onto an intermediate transfer medium and are transferred at a time on a recording medium such as paper and the image is fixed in the same manner as described above.

The charging device 3 is preferably a charging device that is provided in contact with or near the surface of the image bearer, and a discharge wire was used as the charging device 3. According to this charging unit, as compared with a corona discharge device called corotron and scorotron, the amount of ozone generated during the charging can be significantly reduced.

<Process Cartridge>

A process cartridge used in the present invention contains at least an image bearer, the protective layer forming unit according to the present invention and, if necessary, other units such as a charging unit, an exposure unit, a developing unit, a transferring unit, a cleaning unit, and a discharging unit.

The process cartridge can be detachably provided in various electrophotographic apparatus and is preferably detachably provided in the image forming apparatus of the present invention.

Figure 8:
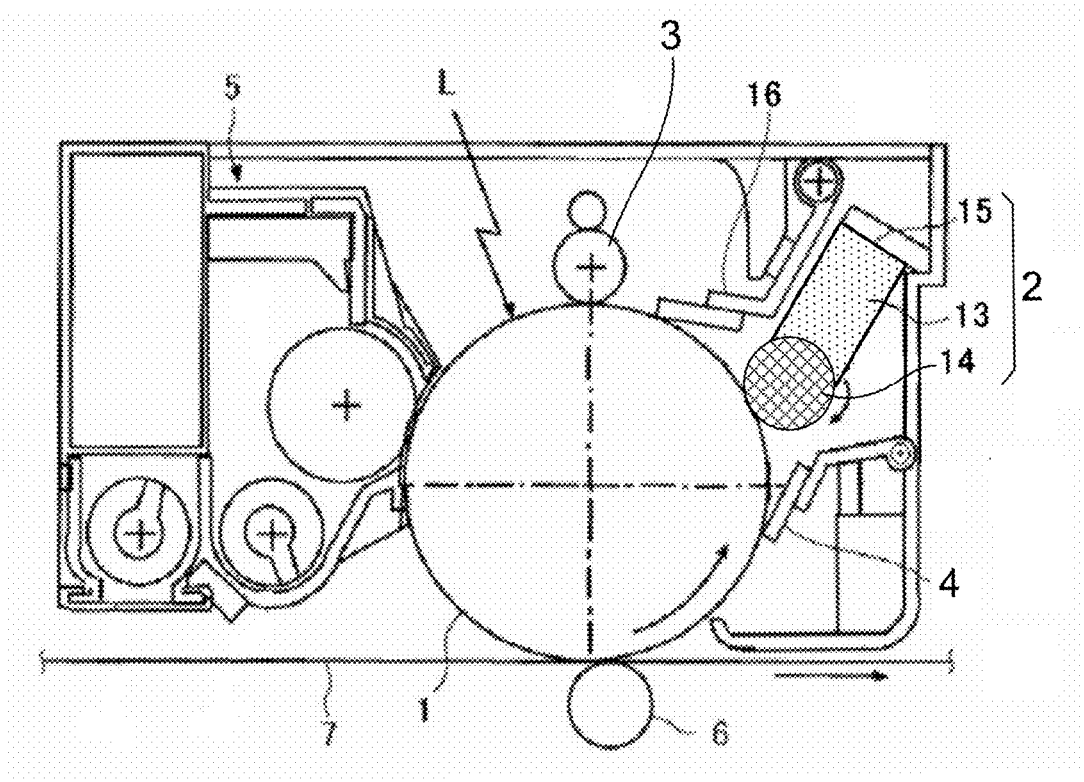
FIG. 8 is a schematic cross-sectional view illustrating one example of the process cartridge used in the present invention.

Here, FIG. 8 is a schematic cross-sectional view illustrating one example of the process cartridge used in the present invention.

In the process cartridge, a protective layer forming apparatus 2 that is provided to face a photoconductor drum 1, and which contains a protecting agent storage member 13, a roller-shaped protecting agent supplying member 14, a powdery image bearer protecting agent 15, and a protective layer forming member 16.

After the transferring step, a photoconductor drum 1 has a surface on which, for example, a partially deteriorated image bearer protecting agent and a toner ingredient stay. The residue on the surface is removed by a cleaning device 4 to clean the surface.

In FIG. 8, the cleaning device 4 is abutted at an angle similar to the so-called counter type (leading type).

Powdery image bearer protecting agent 15 is fed from roller-shaped protecting agent supplying member 14 to the surface of the image bearer, from which the toner that stays on the surface, or the deteriorated protective agent block have been removed by the cleaning device 4, and a film-like protective layer is formed by the protective layer forming member 16.

The image bearer with the protective layer formed thereon is electrified and is exposed to light L such as laser beams to form a electrostatic latent image. The electrostatic latent image is developed with a developing device 5 to form a visible image which is then transferred onto a recording medium 7, for example, by a transferring device 6 located outside the process cartridge.

EXAMPLES

The present invention will be described with reference to the following Examples. However, it should be noted that the present invention is not limited to these Examples.

In the following Examples and Comparative Examples, median diameters (D50) based on the volume standard particle size distribution and bulk densities of a powdery image bearer protecting agents were measured as follows.

<Median Diameter (D50) of Powdery Image Bearer Protecting Agent Based on Volume Standard Particle Size Distribution>

The median diameters (D50) of the powdery image bearer protecting agents was measured with a laser diffraction particle size analyzer (MASTERSIZER 2000, product of Malvern) and the median diameter (D50) was calculated by the obtained volume standard particle size distributions.

<Bulk Density of Powdery Image Bearer Protecting Agent>

The bulk density of powdery image bearer protecting agents was measured with a powder characteristic measuring apparatus which is product of TSUTSUI SCIENTIFIC INSTRUMENTS CO., LTD.

Example 1

<Production of Powdery Image Bearer Protecting Agent 1>

A mixture of 80 parts by mass of zinc stearate (product of NOF CORPORATION, GF200) as the fatty acid metal salt and 20 parts by mass of boron nitride (product of Momentive Performance Technologies Japan, NX5) as the inorganic lubricant was dry-granulated with a roller compactor (FT160, product of FREUND-TURBO CORPORATION) at a compacting pressure of 9 MPa so that the median diameter (D50) based on the volume standard particle size distribution was 290 μm, to thereby produce powdery image bearer protecting agent 1. Note that, the adjustment of the median diameter of the granulated product was performed with a sieving machine for powder (THE IIDA TESTING SIEVE, product of Iida Seisakusho K.K.).

<Protecting Agent Supplying Member 1>

A foamed urethane roller (product of INOAC CORPORATION, ENDURE C 250) was employed as a protecting agent supplying member 1.

The foamed urethane roller (product of INOAC CORPORATION, ENDURE C 250) is a cell diameter of 140 μm, 0.49 g/cm$^3$ of density and 12.6 mm of an outer diameter of roller.

In an image forming apparatus (product of Ricoh Company, Ltd., RICOH PRO C751) illustrated in FIG. 6A, in a portion where image formation is performed, a protective layer forming device 102 is arranged upstream of a cleaning unit 104, and powdery image bearer protecting agent 1 produced in Example 1 is provided at a surface of an image bearer 101. Note that, as shown in FIG. 5A, in the protective layer forming device 102, a powdery protecting agent 121 is stored in a protecting agent storage member 120 and a roller-shaped protecting agent supplying member 122 is rotatably equipped at the tip opening part. By rotating the roller-shaped protecting agent supplying member 122, the powdery image bearer protecting agent is provided at the surface of the image bearer 101. Note that, in Example 1, a regulating member 123 which abuts on the roller-shaped protecting agent supplying member 122 and regulates an image bearer protecting agent is not disposed.

Next, with the image forming apparatus (product of Ricoh Company, Ltd., RICOH PRO C751), a manuscript of which size is A4, having an image area ratio of 5% was continuously printed for 30,000 papers. Then smear of the image bearer and smear of the charging member were evaluated as follows. Results are shown in Table 2-1. Note that, an evaluation was performed in an environment where the charging member is easy to be smeared by using an abraded cleaning blade.

<Smear of Image Bearer>

After continuously printing for 30,000 papers, a degree of the smeared image bearer was visually observed and evaluated based on the following evaluation criteria.

[Evaluation Criteria]

A: No smear is observed.

B: The image bearer is partially smeared, but the output images are not affected by smear, which is an acceptable level.

C: The image bearer is worse level than B, but there is a case where the defective image is not occurred depending on outputted images.

D: The image bearer is completely smeared.

<Smear of Charging Member>

After continuously printing for 30,000 papers, the level of smear and filming of the charging member (the charging roller) are observed depending on the following evaluation criteria.

[Evaluation Criteria]

A: No smear is observed.

B: The image bearer is partially smeared, but the output images are not affected by smear, which is an acceptable level.

C: The image bearer is worse level than B, but there is a case where the defective image is not occurred depending on outputted images.

D: The image bearer is completely smeared.

Example 2

An image forming apparatus of Example 2 was obtained in the same manner as in Example 1 except that powdery image bearer protecting agent 1 was changed to powdery image bearer protecting agent 2 prepared as follows.

Next, in the same manner as in Example 1, using the image forming apparatus of Example 2, smear of the charging member and smear of The image bearer were evaluated. Results are shown in Table 2-1.

<Production of Powdery Image Bearer Protecting Agent 2>

With an Oster mixer (product of Oster, CUBE6640), 80 parts by mass of zinc stearate (product of NOF CORPORATION, GF200) as the fatty acid metal salt and 20 parts by mass of boron nitride (product of Momentive Performance Technologies Japan, NX5) as the inorganic lubricant was mixed. Then, the resultant mixture was melted with a hotplate (product of AS ONE Corporation., RSH-1D). After the melted mixture was naturally allowed to cool, the mixture was pulverized with a pulverizer (product of OSAKA CHEMICAL Co., Ltd., WONDER BLENDER) to thereby product powdery image bearer protecting agent 2, which has the median diameter (D50) of 350 μm based on the volume standard particle size distribution, by a melting pulverized method.

Example 3

An image forming apparatus of Example 3 was obtained in the same manner as in Example 1 except that powdery image bearer protecting agent 1 was changed to powdery image bearer protecting agent 3 prepared as follows.

Next, by using the image forming apparatus of Example 3, smear of the image bearer and smear of the charging member were evaluated in the same manner as in Example 1. Results are shown in Table 2-1.

<Production of Powdery Image Bearer Protecting Agent 3>

A mixture of 80 parts by mass of zinc stearate (product of NOF CORPORATION, GF200) as the fatty acid metal salt and 20 parts by mass of Mica (product of Topy Industries Ltd., PDM-5L) as the inorganic lubricant was dry-granulated with a roller compactor (FT160, product of FREUND-TURBO CORPORATION) at a compacting pressure of 9 MPa so that the median diameter (D50) based on the volume standard particle size distribution was 300 μm, to thereby produce powdery image bearer protecting agent 3.

Example 4

An image forming apparatus of Example 4 was obtained in the same manner as in Example 1 except that powdery image bearer protecting agent 1 was changed to powdery image bearer protecting agent 4 prepared as follows.

Next, by using the image forming apparatus of Example 4, smear of the image bearer and smear of the charging member were evaluated in the same manner as in Example 1. Results are shown in Table 2-1.

<Production of Powdery Image Bearer Protecting Agent 4>

A mixture of 80 parts by mass of zinc stearate (product of NOF CORPORATION, GF200) as the fatty acid metal salt and 20 parts by mass of talc (product of NIPPON TALC Co., Ltd., P-3) as the inorganic lubricant was dry-granulated with a roller compactor (FT160, product of FREUND-TURBO CORPORATION) at a compacting pressure of 9 MPa so that the median diameter (D50) based on the volume standard particle size distribution was 260 μm, to thereby produce powdery image bearer protecting agent 4.

Example 5

An image forming apparatus of Example 5 was obtained in the same manner as in Example 1 except that protecting agent supplying member 1 was changed to the following protecting agent supplying member 2 prepared as follows.

Next, by using the image forming apparatus of Example 5, smear of the image bearer and smear of the charging member were evaluated in the same manner as in Example 1. Results are shown in Table 2-1.

<Protecting Agent Supplying Member 2>

A rubber roller (product of INOAC CORPORATION, NBR HYDRIN RUBBER) as protecting agent supplying member 2 was employed.

The rubber roller (product of INOAC CORPORATION, NBR HYDRIN RUBBER) has a cell diameter of 170 μm, a density of 0.42 g/cm$^3$ and an outer diameter of 12.6 mm of roller.

Example 6

An image forming apparatus of Example 6 was obtained in the same manner as in Example 1 except that powdery image bearer protecting agent 1 was changed to powdery image bearer protecting agent 5 prepared as follows.

Next, by using the image forming apparatus of Example 6, smear of the image bearer and smear of the charging member were evaluated in the same manner as in Example 1. Results are shown in Table 2-1.

<Production of Powdery Image Bearer Protecting Agent 5>

A mixture of 80 parts by mass of calcium stearate (reagent: product of Wako Pure Chemical Industries, Ltd.) as the fatty acid metal salt and 20 parts by mass of boron nitride (product of Momentive Performance Technologies Japan, NX5) as the inorganic lubricant was dry-granulated with a roller compactor (FT160, product of FREUND-TURBO CORPORATION) at a compacting pressure of 9 MPa so that the median diameter (D50) based on the volume standard particle size distribution was 310 μm, to thereby produce powdery image bearer protecting agent 5.

Example 7

An image forming apparatus of Example 7 was obtained in the same manner as in Example 1 except that powdery image bearer protecting agent 1 was changed to powdery image bearer protecting agent 6 prepared as follows.

Next, by using the image forming apparatus of Example 7, smear of the image bearer and smear of the charging member were evaluated in the same manner as in Example 1. Results are shown in Table 2-1.

<Production of Powdery Image Bearer Protecting Agent 6>

A mixture of 80 parts by mass of zinc laurate (reagent: product of Wako Pure Chemical Industries, Ltd.) as the fatty acid metal salt and 20 parts by mass of boron nitride (product of Momentive Performance Technologies Japan, NX5) as the inorganic lubricant was dry-granulated with a roller compactor (FT160, product of FREUND-TURBO CORPORATION) at a compacting pressure of 9 MPa so that the median diameter (D50) based on the volume standard particle size distribution was 280 μm, to thereby produce powdery image bearer protecting agent 6.

Examples 8 to 11

Image forming apparatus of Examples 8 to 11 were obtained in the same manner as in Example 1 except that used was each of the powdery image bearer protecting agents 7 to 10, in which each of the mesh size of a sieving machine for powder was changed in the production of the powdery image bearer protecting agent to adjust to the median diameter (D50) of the granulated product described in Table 2-2

Next, by using the image forming apparatuses of Examples 8 to 11, smear of the image bearer and smear of the charging member were evaluated in the same manner as in Example 1. Results are shown in Table 2-1.

Example 12

An image forming apparatus of Example 12 was obtained in the same manner as in Example 1 except that powdery image bearer protecting agent 1 was changed to powdery image bearer protecting agent 11 prepared as follows.

Next, by using the image forming apparatus of Example 12, smear of the image bearer and smear of the charging member were evaluated in the same manner as in Example 1. Results are shown in Table 2-1.

<Production of Powdery Image Bearer Protecting Agent 11>

A mixture of 92 parts by mass of calcium stearate (reagent: product of Wako Pure Chemical Industries, Ltd.) as the fatty acid metal salt and 8 parts by mass of boron nitride (product of Momentive Performance Technologies Japan, NX5) as the inorganic lubricant was dry-granulated with a roller compactor (FT160, product of FREUND-TURBO CORPORATION) at a compacting pressure of 9 MPa so that the median diameter (D50) based on the volume standard particle size distribution was 500 μm, to thereby produce powdery image bearer protecting agent 11.

Example 13

An image forming apparatus of Example 13 was obtained in the same manner as in Example 1 except that powdery image bearer protecting agent 1 was changed to powdery image bearer protecting agent 12 prepared as follows.

Next, by using the image forming apparatus of Example 13, smear of the image bearer and the charging member were evaluated in the same manner as in Example 1. Results are shown in Table 2-1.

<Production of Powdery Image Bearer Protecting Agent 12>

A mixture of 65 parts by mass of calcium stearate (reagent: product of Wako Pure Chemical Industries, Ltd.) as the fatty acid metal salt and 35 parts by mass of boron nitride (product of Momentive Performance Technologies Japan, NX5) as the inorganic lubricant was dry-granulated with a roller compactor (FT160, product of FREUND-TURBO CORPORATION) at a compacting pressure of 9 MPa so that the median diameter (D50) based on the volume standard particle size distribution was 500 μm, to thereby produce powdery image bearer protecting agent 12.

Example 14

An image forming apparatus of Example 14 was obtained in the same manner as in Example 9 except that a polyethylene telephthalate (PET) sheet (product of CHIYODA INTEGRE CO., LTD.) having a thickness of 0.25 mm as a regulating member 123 in the protective layer forming device 102 of the image forming apparatus shown in FIG. 6A was used, and that the regulating member was disposed to abut on the protecting agent supplying member in an opposite (counter) direction to a rotational direction thereof.

Next, by using the image forming apparatus of Example 14, smear of the image bearer and smear of the charging member were evaluated in the same manner as in Example 1. Results are shown in Table 2-1.

Example 15

An image forming apparatus of Example 15 was obtained in the same manner as in Example 9 except that a stainless steel sheet having a thickness of 0.1 mm as the regulating member 123 in the protective layer forming device 102 of the image forming apparatus shown in FIG. 6A was used and that the regulating member was disposed to abut on the protecting agent supplying member in an opposite (counter) direction to a rotational direction thereof.

Next, by using the image forming apparatus of Example 15, smear of the image bearer and smear of the charging member were evaluated in the same manner as in Example 1. Results are shown in Table 2-1.

Example 16

An image forming apparatus of Example 16 was obtained in the same manner as in Example 9 except that a urethane rubber sheet (product of CHIYODA INTEGRE CO., LTD.) having a thickness of 1 mm as a regulating member 123 in the protective layer forming device 102 of the image forming apparatus shown in FIG. 6A was used, and that the regulating member was disposed to abut on the protecting agent supplying member in an opposite (counter) direction to a rotational direction thereof.

Next, by using the image forming apparatus of Example 16, smear of the image bearer and smear of the charging member were evaluated in the same manner as in Example 1. Results are shown in Table 2-1.

Example 17

An image forming apparatus of Example 17 was obtained in the same manner as in Example 9 except that a polyethylene telephthalate (PET) sheet (product of CHIYODA INTEGRE CO., LTD.) having a thickness of 0.25 mm as a regulating member 123 in the protective layer forming device 102 of the image forming apparatus shown in FIG. 6B was used, and that the regulating member was disposed to abut on the protecting agent supplying member in a forward (trading) direction to a rotational direction thereof.

Next, by using the image forming apparatus of Example 17, smear of the image bearer and smear of the charging member were evaluated in the same manner as in Example 1. Results are shown in Table 2-2.

Example 18

An image forming apparatus of Example 18 was obtained in the same manner as in Example 9 except that a polypropylene (PP) sheet (product of CHIYODA INTEGRE CO., LTD.) having a thickness of 0.25 mm as a regulating member 123 in the protective layer forming device 102 of the image forming apparatus shown in FIG. 6A was used, and that the regulating member was disposed to abut on the protecting agent supplying member in an opposite (counter) direction to a rotational direction thereof.

Next, by using the image forming apparatus of Example 18, smear of the image bearer and smear of the charging member were evaluated in the same manner as in Example 1. Results are shown in Table 2-2.

Example 19

An image forming apparatus of Example 19 was obtained in the same manner as in Example 9 except that the protecting agent supplying member 1 was changed to the protecting agent supplying member 2 (rubber roller), that a polyethylene telephthalate (PET) sheet (product of CHIYODA INTEGRE CO., LTD.) having a thickness of 0.25 mm as a regulating member 123 in the protective layer forming device 102 of the image forming apparatus shown in FIG. 6A was used, and that the regulating member was disposed to abut on the protecting agent supplying member in an opposite (counter) direction to a rotational direction thereof.

Next, by using the image forming apparatus of Example 19, smear of the image bearer and smear of the charging member were evaluated in the same manner as in Example 1. Results are shown in Table 2-2.

Example 20

An image forming apparatus of Example 20 was obtained in the same manner as in Example 9 except that boron nitride was changed to mica as the inorganic lubricant, that a polyethylene telephthalate (PET) sheet (product of CHIYODA INTEGRE CO., LTD.) having a thickness of 0.25 mm as a regulating member 123 in the protective layer forming device 102 of the image forming apparatus shown in FIG. 6A was used, and that the regulating member was disposed to abut on the protecting agent supplying member in an opposite (counter) direction to a rotational direction thereof.

Next, by using the image forming apparatus of Example 20, smear of the image bearer and smear of the charging member were evaluated in the same manner as in Example 1. Results are shown in Table 2-2.

Example 21

An image forming apparatus of Example 21 was obtained in the same manner as in Example 9 except that boron nitride was changed to talc as the inorganic lubricant, and a polyethylene telephthalate (PET) sheet (product of CHIYODA INTEGRE CO., LTD.) having a thickness of 0.25 mm as a regulating member 123 in the protective layer forming device 102 of the image forming apparatus shown in FIG. 6A was used, and that the regulating member was disposed to abut on the protecting agent supplying member in an opposite (counter) direction to a rotational direction thereof.

Next, using the image forming apparatus of Example 21, smear of the image bearer and smear of the charging member were evaluated in the same manner as in Example 1. Results are shown in Table 2-2.

Example 22

An image forming apparatus of Example 22 was obtained in the same manner as in Example 9 except that zinc stearate was changed to calcium stearate as the fatty acid metal salt, that a polyethylene telephthalate (PET) sheet (product of CHIYODA INTEGRE CO., LTD.) having a thickness of 0.25 mm as a regulating member 123 in the protective layer forming device 102 of the image forming apparatus shown in FIG. 6A was used, and that the regulating member was disposed to abut on the protecting agent supplying member in an opposite (counter) direction to a rotational direction thereof.

Next, by using the image forming apparatus of Example 22, smear of the image bearer and smear of the charging member were evaluated in the same manner as in Example 1. Results are shown in Table 2-2.

Example 23

An image forming apparatus of Example 23 was obtained in the same manner as in Example 9 except that zinc stearate was changed to zinc laurate as the fatty acid metal salt, and a polyethylene telephthalate (PET) sheet (product of CHIYODA INTEGRE CO., LTD.) having a thickness of 0.25 mm as a regulating member 123 in the protective layer forming device 102 of the image forming apparatus shown in FIG. 6A was used, and that the regulating member was disposed to abut on the protecting agent supplying member in an opposite (counter) direction to a rotational direction thereof.

Next, by using the image forming apparatus of Example 23, smear of the image bearer and smear of the charging member were evaluated in the same manner as in Example 1. Results are shown in Table 2-2.

Examples 24 to 26

Image forming apparatuses of Examples 24 to 26 were obtained in the same manner as in Example 9 except that the protecting agent storage member 120 in the protective layer forming device 102 of the image forming apparatus shown in FIG. 6A was changed to a protecting agent storage members as shown in FIG. 5B where polyethylene telephthalate (PET) resin plates each having a thickness of 1 mm were attached with an adhesive to thereby form partition walls therein so that partitions in the protecting agent storage member were formed in a number shown in Table 2-2.

Next, by using the image forming apparatuses of Examples 24 to 26, smear of the image bearer and smear of the charging member were evaluated in the same manner as in Example 1. Results are shown in Table 2-2.

Example 27

An image forming apparatus of Example 27 was obtained in the same manner as in Example 20 except that the protecting agent storage member 120 in the protective layer forming device 102 of the image forming apparatus shown in FIG. 6A was changed to a protecting agent storage members as shown in FIG. 5B where polyethylene telephthalate (PET) resin plates each having a thickness of 1 mm were attached with an adhesive to thereby form partition walls therein so that partitions in the protecting agent storage member were formed in a number shown in Table 2-2.

Next, by using the image forming apparatus of Example 27, smear of the image bearer and smear of the charging member were evaluated in the same manner as in Example 1. Results are shown in Table 2-2.

Example 28

An image forming apparatus of Example 28 was obtained in the same manner as in Example 27 except that boron nitride was changed to talc as the inorganic lubricant.

Next, by using the image forming apparatus of Example 28, smear of the image bearer and the smear of the charging member were evaluated in the same manner as in Example 1. Results are shown in Table 2-2.

Examples 29 to 30

Image forming apparatuses of Examples 29 to 30 were obtained in the same manner as in Example 22 except that the protecting agent storage member 120 in the protective layer forming device 102 of the image forming apparatus shown in FIG. 6A was changed to a protecting agent storage members as shown in FIG. 5B where polyethylene telephthalate (PET) resin plates each having a thickness of 1 mm were attached with an adhesive to thereby form partition walls therein so that partitions in the protecting agent storage member were formed in a number shown in Table 2-2.

Next, by using the image forming apparatuses of Examples 29 to 30, smear of the image bearer and smear of the charging member were evaluated in the same manner as in Example 1. Results are shown in Table 2-2.

Example 31

An image forming apparatus of Example 31 was obtained in the same manner as in Example 19 except that the protecting agent storage member 120 in the protective layer forming device 102 of the image forming apparatus shown in FIG. 6A was changed to a protecting agent storage members as shown in FIG. 5B where polyethylene telephthalate (PET) resin plates each having a thickness of 1 mm were attached with an adhesive to thereby form partition walls therein so that partitions in the protecting agent storage member were formed in a number shown in Table 2-2.

Next, by using the image forming apparatus of Example 31, smear of the image bearer and smear of the charging member were evaluated in the same manner as in Example 1. Results are shown in Table 2-2.

Comparative Example 1

An image forming apparatus of Comparative Example 1 was obtained in the same manner as in Example 1 except that powdery image bearer protecting agent 1 was changed to powdery image bearer protecting agent 13 prepared as follows.

Next, by using the image forming apparatus of Comparative Example 1, smear of the image bearer and smear of the charging member were evaluated in the same manner as in Example 1. Results are shown in Table 2-3.

<Production of Powdery Image Bearer Protecting Agent 13>

With an Oster mixer (product of Oster, CUBE6640), 80 parts by mass of zinc stearate (product of NOF CORPORATION, GF200) as the fatty acid metal salt and 20 parts by mass of boron nitride (product of Momentive Performance Technologies Japan, NX5) as the inorganic lubricant were mixed (non-granulation) to thereby produce powdery image bearer protecting agent 13, which has the median diameter (D50) of 290 μm based on the volume standard particle size distribution.

Comparative Example 2

An image forming apparatus of Comparative Example 2 was obtained in the same manner as in Example 9 except that protecting agent supplying member 1 was changed to the following protecting agent supplying member 3.

Next, by using the image forming apparatus of Comparative Example 2, smear of the image bearer and smear of the charging member were evaluated in the same manner as in Example 1. Results are shown in Table 2-3.

<Protecting Agent Supplying Member 3>

A brush (product of Tsuchiya Co., Ltd., 6D50K) was employed as protecting agent supplying member 3.

The brush (product of Tsuchiya Co., Ltd., 6D50K) has the quality of the material: polyethylene telephthalate (PET) and has an external diameter of 12.6 mm.

Comparative Example 3

An image forming apparatus of Comparative Example 3 was obtained in the same manner as in Example 1 except that powdery image bearer protecting agent 1 was changed to powdery image bearer protecting agent 14 prepared as follows.

Next, by using the image forming apparatus of Comparative Example 3, smear of the image bearer and smear of the charging member were evaluated in the same manner as in Example 1. Results are shown in Table 2-3.

<Production of Powdery Image Bearer Protecting Agent 14>

An inorganic lubricant was not added, and 100 parts by mass of zinc stearate (product of NOF CORPORATION, GF200) as the fatty acid metal salt was dry-granulated with a roller compactor (FT160, product of FREUND-TURBO CORPORATION) at a compacting pressure of 9 MPa so that the median diameter (D50) based on the volume standard particle size distribution was 320 μm, to thereby produce powdery image bearer protecting agent 14.

Comparative Example 4

An image forming apparatus of Comparative Example 4 was obtained in the same manner as in Comparative Example 2 except that a polyethylene telephthalate (PET) sheet (product of CHIYODA INTEGRE CO., LTD.) having a thickness of 0.25 mm as a regulating member was used, and that the regulating member was disposed to abut on the protecting agent supplying member in an opposite (counter) direction to a rotational direction thereof.

Next, by using the image forming apparatus of Comparative Example 4, smear of the image bearer and smear of the charging member were evaluated in the same manner as in Example 1. Results are shown in Table 2-3.

Comparative Example 5

An image forming apparatus of Comparative Example 5 was obtained in the same manner as in Example 25 except that the inorganic lubricant was not used.

Next, by using the image forming apparatus of Comparative Example 5, smear of the image bearer and smear of the charging member were evaluated in the same manner as in Example 1. Results are shown in Table 2-3.

Comparative Example 6

An image forming apparatus of Comparative Example 6 was obtained in the same manner as in Example 25 except that powdery image bearer protecting agent 1 was changed to protecting agent supplying member 3 (brush).

Next, by using the image forming apparatus of Comparative Example 6, smear of the image bearer and smear of the charging member were evaluated in the same manner as in Example 1. Results are shown in Table 2-3.

Tables 1-1, 1-2, and 1-3 collectively show materials and conditions employed in Examples 1 to 31 and Comparative Examples 1 to 6.

TABLE 1-1

| | Protecting agent products by | Protecting agent supplying members | Fatty acid metal salts | Inorganic lubricants | Regulating members | Abutting directions |
|---|---|---|---|---|---|---|
| Example 1 | Dry granulation | Foamed urethane roller | Zinc stearate | Boron nitride | Nothing | Nothing |
| Example 2 | Melting crushed | Foamed urethane roller | Zinc stearate | Boron nitride | Nothing | Nothing |
| Example 3 | Dry granulation | Foamed urethane roller | Zinc stearate | Mica | Nothing | Nothing |
| Example 4 | Dry granulation | Foamed urethane roller | Zinc stearate | Talc | Nothing | Nothing |
| Example 5 | Dry granulation | Rubber roller | Zinc stearate | Boron nitride | Nothing | Nothing |
| Example 6 | Dry granulation | Foamed urethane roller | Calcium stearate | Boron nitride | Nothing | Nothing |
| Example 7 | Dry granulation | Foamed urethane roller | Zinc laurate | Boron nitride | Nothing | Nothing |
| Example 8 | Dry granulation | Foamed urethane roller | Zinc stearate | Boron nitride | Nothing | Nothing |
| Example 9 | Dry granulation | Foamed urethane roller | Zinc stearate | Boron nitride | Nothing | Nothing |
| Example 10 | Dry granulation | Foamed urethane roller | Zinc stearate | Boron nitride | Nothing | Nothing |
| Example 11 | Dry granulation | Foamed urethane roller | Zinc stearate | Boron nitride | Nothing | Nothing |
| Example 12 | Dry granulation | Foamed urethane roller | Calcium stearate | Boron nitride | Nothing | Nothing |
| Example 13 | Dry granulation | Foamed urethane roller | Calcium stearate | Boron nitride | Nothing | Nothing |
| Example 14 | Dry granulation | Foamed urethane roller | Zinc stearate | Boron nitride | PET | Counter |
| Example 15 | Dry granulation | Foamed urethane roller | Zinc stearate | Boron nitride | Stainless steel | Counter |
| Example 16 | Dry granulation | Foamed urethane roller | Zinc stearate | Boron nitride | Urethane rubber | Counter |

TABLE 1-2

| | Protecting agent products by | Protecting agent supplying members | Fatty acid metal salts | Inorganic lubricants | Regulating members | Abutting directions |
|---|---|---|---|---|---|---|
| Example 17 | Dry granulation | Foamed urethane roller | Zinc stearate | Boron nitride | PET | Trading |
| Example 18 | Dry granulation | Foamed urethane roller | Zinc stearate | Boron nitride | PP | Counter |
| Example 19 | Dry granulation | Rubber roller | Zinc stearate | Boron nitride | PET | Counter |
| Example 20 | Dry granulation | Foamed urethane roller | Zinc stearate | Mica | PET | Counter |
| Example 21 | Dry granulation | Foamed urethane roller | Zinc stearate | Talc | PET | Counter |
| Example 22 | Dry granulation | Foamed urethane roller | Calcium stearate | Boron nitride | PET | Counter |
| Example 23 | Dry granulation | Foamed urethane roller | Zinc laurate | Boron nitride | PET | Counter |
| Example 24 | Dry granulation | Foamed urethane roller | Zinc stearate | Boron nitride | Nothing | Nothing |
| Example 25 | Dry granulation | Foamed urethane roller | Zinc stearate | Boron nitride | Nothing | Nothing |
| Example 26 | Dry granulation | Foamed urethane roller | Zinc stearate | Boron nitride | Nothing | Nothing |
| Example 27 | Dry granulation | Foamed urethane roller | Zinc stearate | Mica | PET | Counter |
| Example 28 | Dry granulation | Foamed urethane roller | Zinc stearate | Talc | PET | Counter |
| Example 29 | Dry granulation | Foamed urethane roller | Calcium stearate | Boron nitride | PET | Counter |
| Example 30 | Dry granulation | Foamed urethane roller | Calcium stearate | Boron nitride | PET | Counter |
| Example 31 | Dry granulation | Rubber roller | Zinc stearate | Boron nitride | PET | Counter |

TABLE 1-3

| | Protecting agent products by: | Protecting agent supplying members | Fatty acid metal salts | Inorganic lubricants | Regulating members | Abutting directions |
|---|---|---|---|---|---|---|
| Comparative Example 1 | Mixture (non-granulation) | Foamed urethane roller | Zinc stearate | Boron nitride | Nothing | Nothing |
| Comparative Example 2 | Dry granulation | Brush | Zinc stearate | Boron nitride | Nothing | Nothing |
| Comparative Example 3 | Dry granulation | Foamed urethane roller | Zinc stearate | — | Nothing | Nothing |
| Comparative Example 4 | Dry granulation | Brush | Zinc stearate | Boron nitride | PET | Counter |
| Comparative Example 5 | Dry granulation | Foamed urethane roller | Zinc stearate | — | Nothing | Nothing |
| Comparative Example 6 | Dry granulation | Brush | Zinc stearate | Boron nitride | Nothing | Nothing |

TABLE 2-1

| | Mixing mass ratios (fatty acid metal salt/ inorganic lubricant) | Number of partitions of protecting agent storage members | Median diameters (D50) of protecting agents | Bulk densities (g/cm$^3$) of protecting agents | Smear of charging members | Smear of image bearers |
|---|---|---|---|---|---|---|
| Example 1 | 80/20 | — | 290 μm | 0.5 | B | B |
| Example 2 | 80/20 | — | 350 μm | 0.68 | C | B |
| Example 3 | 80/20 | — | 300 μm | 0.53 | B | B |
| Example 4 | 80/20 | — | 260 μm | 0.44 | C | B |
| Example 5 | 80/20 | — | 290 μm | 0.5 | B | B |
| Example 6 | 80/20 | — | 310 μm | 0.5 | B | C |
| Example 7 | 80/20 | — | 280 μm | 0.5 | B | C |
| Example 8 | 80/20 | — | 110 μm | 0.4 | B | B |
| Example 9 | 80/20 | — | 500 μm | 0.72 | B | B |
| Example 10 | 80/20 | — | 1100 μm | 0.78 | B | C |
| Example 11 | 80/20 | — | 50 μm | 0.37 | C | B |
| Example 12 | 92/8 | — | 500 μm | 0.72 | C | B |
| Example 13 | 65/35 | — | 500 μm | 0.72 | C | B |
| Example 14 | 80/20 | — | 500 μm | 0.72 | A | A |
| Example 15 | 80/20 | — | 500 μm | 0.72 | B | B |
| Example 16 | 80/20 | — | 500 μm | 0.72 | B | A |

TABLE 2-2

| | Mixing mass ratios (fatty acid metal salt/ inorganic lubricant) | Number of partitions of protecting agent storage members | Median diameters (D50) of protecting agents | Bulk densities (g/cm$^3$) of protecting agents | Smear of charging members | Smear of image bearers |
|---|---|---|---|---|---|---|
| Example 17 | 80/20 | — | 500 μm | 0.72 | B | A |
| Example 18 | 80/20 | — | 500 μm | 0.72 | A | A |
| Example 19 | 80/20 | — | 500 μm | 0.72 | A | A |
| Example 20 | 80/20 | — | 515 μm | 0.73 | B | A |
| Example 21 | 80/20 | — | 510 μm | 0.73 | B | A |
| Example 22 | 80/20 | — | 505 μm | 0.73 | B | B |
| Example 23 | 80/20 | — | 508 μm | 0.73 | B | B |

TABLE 2-2-continued

| | Mixing mass ratios (fatty acid metal salt/ inorganic lubricant) | Number of partitions of protecting agent storage members | Median diameters (D50) of protecting agents | Bulk densities (g/cm$^3$) of protecting agents | Smear of charging members | Smear of image bearers |
|---|---|---|---|---|---|---|
| Example 24 | 80/20 | 15 | 500 μm | 0.72 | A | B |
| Example 25 | 80/20 | 10 | 500 μm | 0.72 | A | B |
| Example 26 | 80/20 | 5 | 500 μm | 0.72 | A | B |
| Example 27 | 80/20 | 10 | 515 μm | 0.73 | B | A |
| Example 28 | 80/20 | 10 | 515 μm | 0.73 | B | A |
| Example 29 | 80/20 | 10 | 505 μm | 0.73 | A | A |
| Example 30 | 80/20 | 10 | 505 μm | 0.73 | A | A |
| Example 31 | 80/20 | 10 | 500 μm | 0.72 | A | A |

TABLE 2-3

| | Mixing mass ratios (fatty acid metal salt/ inorganic lubricant) | Number of partitions of protecting agent storage members | Median diameters (D50) of protecting agents | Bulk densities (g/cm$^3$) of protecting agents | Smear of charging members | Smear of image bearers |
|---|---|---|---|---|---|---|
| Comparative Example 1 | 80/20 | — | 290 μm | 0.2 | D | C |
| Comparative Example 2 | 80/20 | — | 500 μm | 0.72 | D | B |
| Comparative Example 3 | 100/0 | — | 320 μm | 0.5 | D | B |
| Comparative Example 4 | 80/20 | — | 500 μm | 0.72 | D | B |
| Comparative Example 5 | 80/20 | 10 | 500 μm | 0.72 | D | D |
| Comparative Example 6 | 80/20 | 10 | 500 μm | 0.72 | A | D |

Next, in Example 9, Examples 24 to 31, and Comparative Examples 5 to 6, each of the storage states of the powdery image bearer protecting agents was evaluated in a protecting agent storage member as described hereinafter. Results are shown in Table 3.

<Storage State of Powdery Image Bearer Protecting Agent in Protecting Agent Storage Member>

Each of the storage states of powdery image bearer protecting agents in the protecting agent storage member after test was visually observed and evaluated based on the following criteria.

[Evaluation Criteria]

A: No localization of the powdery image bearer protecting agent is observed.

B: Localization of the powdery image bearer protecting agent is slightly observed.

C: Localization of the powdery image bearer protecting agent is observed, which is an acceptable level.

D: Severe localization of the powdery image bearer protecting agent is observed.

TABLE 3

| | Protecting agent supplying members | Fatty acid metal salts | Inorganic lubricants | Regulating members | Number of partitions of protecting agent storage members | Smear of charging members | Smear of image bearers | Evenness conditions of protecting agents |
|---|---|---|---|---|---|---|---|---|
| Example 9 | Foamed urethane roller | Zinc stearate | Boron nitride | Nothing | Not separated | B | B | C |
| Example 24 | Foamed urethane roller | Zinc stearate | Boron nitride | Nothing | 15 | A | A | A |
| Example 25 | Foamed urethane roller | Zinc stearate | Boron nitride | Nothing | 10 | A | A | A |
| Example 26 | Foamed urethane roller | Zinc stearate | Boron nitride | Nothing | 5 | A | B | B |
| Example 27 | Foamed urethane roller | Zinc stearate | Mica | PET | 10 | B | A | A |
| Example 28 | Foamed urethane roller | Zinc stearate | Talc | PET | 10 | B | A | A |
| Example 29 | Foamed urethane roller | Calcium stearate | Boron nitride | PET | 10 | A | A | A |
| Example 30 | Foamed urethane roller | Calcium stearate | Boron nitride | PET | 15 | A | A | A |
| Example 31 | Rubber roller | Zinc stearate | Boron nitride | PET | 10 | A | A | A |
| Comparative Example 5 | Formed urethane roller | Zinc stearate | — | Nothing | 10 | D | D | A |
| Comparative Example 6 | Brush | Zinc stearate | Boron nitride | Nothing | 10 | A | D | A |

Aspects of the present invention are, for example, as follows.

<1> A protective layer forming device, including:

a powdery image bearer protecting agent formed of a granulated product containing a fatty acid metal salt and an inorganic lubricant; and a roller-shaped protecting agent supplying member configured to supply the powdery image bearer protecting agent to a surface of an image bearer.

<2> The protective layer forming device according to <1>, wherein a median diameter (D50) of the granulated product based on a volume standard particle size distribution thereof as measured with a laser diffraction scattering particle size distribution measurement method is from 50 μm to 1,100 μm.

<3> The protective layer forming device according to <1> or <2>, wherein the granulated product is a granulated product granulated by dry granulation.

<4> The protective layer forming device according to any one of <1> to <3>, wherein the roller-shaped protecting agent supplying member is a foamed urethane roller or a rubber roller.

<5> The protective layer forming device according to any one of <1> to <4>, further including a regulating member which abuts on the roller-shaped protecting agent supplying member and regulates the powdery image bearer protecting agent.

<6> The protective layer forming device according to <5>, wherein the regulating member abuts on the roller-shaped protecting agent supplying member in an opposite direction to a rotational direction of the roller-shaped protecting agent supplying member.

<7> The protective layer forming device according to any one of <1> to <6>, further including a protecting agent storage member which stores the powdery image bearer protecting agent in partitions thereof.

<8> The protective layer forming device according to any one of <1> to <7>, wherein the fatty acid metal salt is zinc stearate, calcium stearate or zinc laurate, or any combination thereof.

<9> The protective layer forming device according to any one of <1> to <8>, wherein the inorganic lubricant is boron nitride, mica or talc, or any combination thereof.

<10> The protective layer forming device according to any one of <1> to <9>, wherein a mass ratio (fatty acid metal salt/inorganic lubricant) of the fatty acid metal salt to the inorganic lubricant in the granulated product is from 92/8 to 65/35.

<11> The protective layer forming device according to any one of <1> to <10>, further including a protective layer forming member configured to press the image bearer protecting agent supplied to the image bearer to form a protective layer on a surface of the image bearer.

<12> An image forming apparatus, including:

an image bearer;

an electrostatic latent image forming unit configured to form an electrostatic latent image on the image bearer;

a developing unit configured to develop the electrostatic latent image with a toner to form a visible image;

a transfer unit configured to transfer the visible image onto a recording medium; and a protective layer forming unit configured to apply an image bearer protecting agent to a surface of the image bearer after the visible image has been transferred from the image bearer, wherein the protective layer forming unit is the protective layer forming device according to any one of <1> to <11>.

This application claims priority to Japanese application No. 2013-044882, filed on Mar. 7, 2013, Japanese application No. 2013-238483, filed on Nov. 19, 2013, and Japanese application No. 2014-045579, filed on Mar. 7, 2014, and incorporated herein by reference.

What is claimed is:

1. A protective layer forming device, comprising:

a powdery image bearer protecting agent formed of a granulated product containing a fatty acid metal salt and an inorganic lubricant, the granulated product including particles obtained by allowing powder to undergo adhesion and at least one of aggregation and compression; and a roller-shaped protecting agent supplying member configured to supply the powdery image bearer protecting agent to a surface of an image bearer, wherein a median diameter (D50) of the granulated product based on a volume standard particle size distribution thereof as measured with a laser diffraction scattering particle size distribution measurement method is from 50 μm to 1,100 μm.

2. The protective layer forming device according to claim 1, wherein the granulated product is a granulated product granulated by dry granulation.

3. The protective layer forming device according to claim 1, wherein the roller-shaped protecting agent supplying member is a foamed urethane roller or a rubber roller.

4. The protective layer forming device according to claim 1, further comprising a regulating member which abuts on the roller-shaped protecting agent supplying member and regulates the powdery image bearer protecting agent.

5. The protective layer forming device according to claim 4, wherein the regulating member abuts on the roller-shaped protecting agent supplying member in an opposite direction to a rotational direction of the roller-shaped protecting agent supplying member.

6. The protective layer forming device according to claim 1, further comprising a protecting agent storage member which stores the powdery image bearer protecting agent in partitions thereof.

7. The protective layer forming device according to claim 1, wherein the fatty acid metal salt is zinc stearate, calcium stearate or zinc laurate, or any combination thereof.

8. The protective layer forming device according to claim 1, wherein the inorganic lubricant is boron nitride, mica or talc, or any combination thereof.

9. The protective layer forming device according to claim 1, wherein a mass ratio (fatty acid metal salt/inorganic lubricant) of the fatty acid metal salt to the inorganic lubricant in the granulated product is from 92/8 to 65/35.

10. The protective layer forming device according to claim 1, further comprising a protective layer forming member configured to press the image bearer protecting agent supplied to the image bearer to form a protective layer on a surface of the image bearer.

11. An image forming apparatus, comprising:

an image bearer;

an electrostatic latent image forming unit configured to form an electrostatic latent image on the image bearer;

a developing unit configured to develop the electrostatic latent image with a toner to form a visible image;

a transfer unit configured to transfer the visible image onto a recording medium; and a protective layer forming unit configured to apply an image bearer protecting agent to a surface of the image bearer after the visible image has been transferred from the image bearer, the protective layer forming unit including, a powdery image bearer protecting agent formed of a granulated product containing a fatty acid metal salt and an inorganic lubricant, the granulated product including particles obtained by allowing powder to undergo adhesion and at least one of aggregation and compression, and a roller-shaped protecting agent supplying member configured to supply the powdery image bearer protecting agent to a surface of an image bearer, wherein a median diameter (D50) of the granulated product based on a volume standard particle size distribution thereof as measured with a laser diffraction scattering particle size distribution measurement method is from 50 μm to 1,100μm.

* * * * *